US008059974B2

(12) United States Patent
Yamaguchi

(10) Patent No.: US 8,059,974 B2
(45) Date of Patent: Nov. 15, 2011

(54) IMAGE FORMING APPARATUS AND INFORMATION PROCESSING METHOD THEREOF

(75) Inventor: Kotaro Yamaguchi, Tokyo (JP)

(73) Assignee: Canon Kabushiki Kaisha (JP)

( * ) Notice: Subject to any disclaimer, the term of this patent is extended or adjusted under 35 U.S.C. 154(b) by 836 days.

(21) Appl. No.: 12/101,153

(22) Filed: Apr. 11, 2008

(65) Prior Publication Data

US 2008/0273882 A1 Nov. 6, 2008

(30) Foreign Application Priority Data

Apr. 13, 2007 (JP) ..... 2007-106365

(51) Int. Cl.
*G03G 15/00* (2006.01)

(52) U.S. Cl. ..... 399/8; 399/24

(58) Field of Classification Search ..... 399/8, 24
See application file for complete search history.

(56) References Cited

U.S. PATENT DOCUMENTS 7,085,503 B2 * 8/2006 Mokuya ..... 399/8
2003/0139982 A1 7/2003 Schwartz et al.

FOREIGN PATENT DOCUMENTS

JP 10-32659 A 2/1998

* cited by examiner

*Primary Examiner* — David Gray
*Assistant Examiner* — Andrew Do
(74) *Attorney, Agent, or Firm* — Rossi, Kimms & McDowell LLP

(57) ABSTRACT

In an image forming apparatus capable of communicating with a monitoring device for monitoring the operating states of a plurality of image forming apparatuses, the operating amount of a part is detected, information about the operating amount is stored in relation to the part, and the stored information is sent to the monitoring device, the first consumed level of the part, which is calculated by the monitoring device based on the sent information, is acquired, and the acquired first consumed level is output in relation to the part. The second consumed level is calculated based on the stored information. When the first consumed level is acquired from the monitoring device, the first consumed level is output. When the first consumed level cannot be acquired from the monitoring device, the calculated second consumed level is output.

11 Claims, 27 Drawing Sheets

FIG. 7

600

| 601 PART CODE | 602 CURRENT COUNT | 603 COUNT ON A PREVIOUS EXCHANGED TIME | 604 FLAG INDICATING INFORMING OF COUNTER ON PREVIOUS EXCHANGED TIME | 605 AVERAGED RESULTS VALUE | 606 CONSUMED LEVEL |
|---|---|---|---|---|---|
| 10000001 | 37148 | 248395 | OFF | 250000 | 14 |
| 10000002 | 0 | 0 | ON | 500000 | 0 |
| 10000004 | 0 | 0 | ON | 500000 | 0 |
| 10000010 | 38204 | 250039 | OFF | 242893 | 14 |
| 20000001 | 146225 | 1194827 | ON | 1000000 | 13 |
| 20000005 | 42451 | 294021 | ON | 315932 | 14 |
| 20000011 | 55307 | 279301 | ON | 258391 | 19 |
| 30000001 | 204891 | 604820 | OFF | 628109 | 33 |
| ⋮ | ⋮ | ⋮ | ⋮ | ⋮ | ⋮ |

FIG. 9

1500

| | |
|---|---|
| SEQUENCE NUMBER | 1501 |
| COMMAND CODE ="PART COUNTER TRANSMISSION" | 1502 |
| NUMBER OF PART COUNTER INFORMATION = N | 1503 |
| PART CODE 1 | 1504 |
| PART COUNTER VALUE FOR PART CODE 1 | 1505 |
| COUNTER VALUE ON PREVIOUS EXCHANGED TIME FOR PART CODE 1 | 1506 |
| PART CODE 2 | |
| PART COUNTER VALUE FOR PART CODE 2 | |
| COUNTER VALUE ON PREVIOUS EXCHANGED TIME FOR PART CODE 2 | |
| ⋮ | |
| PART CODE N | |
| PART COUNTER VALUE FOR PART CODE N | |
| COUNTER VALUE ON PREVIOUS EXCHANGED TIME FOR PART CODE N | |

※N = 0xFFFF INDICATES ALL PART COUNTER VALUES

FIG. 10A

```
<?xml version='1.0'?>
<env:Envelope
  xmlns:env="http://schemas.xmlsoap.org/soap/envelope/"
  xmlns:xsi="http://www.w3.org/2001/XMLSchema-instance"
  xmlns:xsd="http://www.w3.org/2001/XMLSchema"
  xmlns:enc="http://schemas.xmlsoap.org/soap/encoding/"
  xmlns:ns="http://www.xxx.com/server"
  env:encodingStyle="http://schemas.xmlsoap.org/soap/encoding/">
  <env:Body>
    <ns:PART COUNTER TRANSMISSION >
      <ns:COPYING MACHINE ID xsi:type="xsd:string">YPS5883A</ns: COPYING MACHINE ID >
      <ns:PART COUNTER LIST enc:arrayType="ns:PART COUNTER [50]"xsi:type="enc:Array">
        <item xsi:type="ns: PART COUNTER ">
          <key xsi:type="xsd:short">0</key>
          <ns:PART CODE xsi:type="xsd:long">10000001</ns:PART CODE >
          <ns:PART COUNTER VALUE xsi:type="xsd:long">37148</ns: PART COUNTER VALUE>
          <ns:PART COUNTER VALUE ON PREVIOUS EXCHANGED TIME xsi: type="xsd:long">255931</ns: PART COUNTER VALUE ON PREVIOUS EXCHANGED TIME>
        </item>
        <item xsi:type="ns: PART COUNTER ">
          <key xsi:type="xsd:short">1</key>
          <ns:PART CODE xsi:type="xsd:long">10000002</ns: PART CODE >
          <ns:PART COUNTER VALUE xsi:type="xsd:long">49024</ns:PART COUNTER VALUE>
          <ns:PART COUNTER VALUE ON PREVIOUS EXCHANGED TIME xsi:type="xsd:long">419853</ns: PART COUNTER VALUE ON PREVIOUS EXCHANGED TIME>
        </item>
          :
```

FIG. 10B

```
        <item xsi:type="ns: PART COUNTER ">
          <key xsi:type="xsd:short">48</key>
          <ns:PART CODE xsi:type="xsd:long">30005201</ns:PART CODE >
          <ns:PART COUNTER VALUE xsi:type="xsd:long">5534</ns:PART COUNTER VALUE >
          <ns:PART COUNTER VALUE ON PREVIOUS EXCHANGED TIME xsi:type="xsd:long">1039451</ns:PART COUNTER VALUE ON PREVIOUS EXCHANGED TIME>
        </item>
        <item xsi:type="ns: PART COUNTER ">
          <key xsi:type="xsd:short">49</key>
          <ns: PART CODE xsi:type="xsd:long">30005212</ns: PART CODE>
          <ns: PART COUNTER VALUE xsi:type="xsd:long">29405</ns:PART COUNTER VALUE >
          <ns: PART COUNTER VALUE ON PREVIOUS EXCHANGED TIME xsi:type="xsd:long">158320</ns:PART COUNTER VALUE ON PREVIOUS EXCHANGED TIME >
        </item>
      </ns: PART COUNTER LIST >
    </ns: PART COUNTER TRANSMISSION >
  </env:Body>
</env:Envelope>
```

FIG. 11A

```
<?xml version='1.0'?>
<env:Envelope
   xmlns:env="http://schemas.xmlsoap.org/soap/envelope/"
   xmlns:xsi="http://www.w3.org/2001/XMLSchema-instance"
   xmlns:xsd="http://www.w3.org/2001/XMLSchema"
   xmlns:enc="http://schemas.xmlsoap.org/soap/encoding/"
   xmlns:ns="http://www.xxx.com/server"
   env:encodingStyle="http://shemas.xmlsoap.org/soap/encoding/">
   <env:Body>
      <ns:PART COUNTER RESPONSE >
         <ns: COPYING MACHINE ID xsi:type="xsd:string">YPS5883A</ns:COPYING MACHINE ID >
         <ns: PART COUNTER RESPONSE LIST enc:arrayType="ns: PART CONSUMED LEVEL [50]" xsi:type="enc:Array">
            <item xsi:type="ns: PART CONSUMED LEVEL">
               <key xsi:type="xsd:short">0</key>
               <ns:PART CODE xsi:type="xsd:long">10000001</ns:PART CODE>
               <ns:CONSUMED LEVEL xsi:type="xsd:short"></ns: CONSUMED LEVEL>
               <ns:AVERAGED RESULTS VALUE xsi:type="xsd:long">269403</ns: AVERAGED RESULTS VALUE>
            </item>
            <item xsi:type="ns:PART COUNTER ">
               <key xsi:type="xsd:short">1</key>
               <ns: PART CODE xsi:type="xsd:long">10000002</ns:PART CODE >
               <ns: CONSUMED LEVEL xsi:type="xsd:short">51</ns: CONSUMED LEVEL>
               <ns: AVERAGED RESULTS VALUE xsi:type="xsd:long">483021</ns: AVERAGED RESULTS VALUE >
            </item>
               :
               :
```

FIG. 11B

```
        <item xsi:type="ns:PART COUNTER ">
            <key xsi:type="xsd:short">48</key>
            <ns:PART CODE xsi:type="xsd:long">30005201</ns:PART CODE >
            <ns:CONSUMED LEVEL xsi:type="xsd:short">20</ns:CONSUMED LEVEL>
            <ns:AVERAGED RESULTS VALUE xsi:type="xsd:long">1069382</ns:AVERAGED RESULTS VALUE>
        </item>
        <item xsi:type="ns:PART COUNTER ">
            <key xsi:type="xsd:short">49</key>
            <ns:PART CODE xsi:type="xsd:long">30005212</ns:PART CODE>
            <ns:CONSUMED LEVEL xsi:type="xsd:short"></ns:CONSUMED LEVEL>
            <ns:AVERAGED RESULTS VALUE xsi:type="xsd:long">155948</ns:AVERAGED RESULTS VALUE>
        </item>
      </ns:PART COUNTER RESPONSE LIST>
    </ns:PART COUNTER RESPONSE>
  </env:Body>
<env:Envelope>
```

FIG. 14

1300

| 1301 PART CODE | 1302 AVERAGED RESULTS VALUE | 1303 EXCHANGED RESULTS NUMBER | 1304 CALCULATING EXPRESSION |
|---|---|---|---|
| 10000001 | 269403 | 234 | — |
| 10000002 | 483021 | 531 | F1(x) |
| ⋮ | ⋮ | ⋮ | ⋮ |
| 20000001 | 1128492 | 3053 | — |
| 20000002 | 1589202 | 6346 | — |
| ⋮ | ⋮ | ⋮ | ⋮ |
| 20000011 | 289320 | 4418 | F2(x) |
| ⋮ | ⋮ | ⋮ | ⋮ |
| 30000001 | 628109 | 1052 | F3(x) |
| 30000002 | 487294 | 789 | — |
| ⋮ | ⋮ | ⋮ | ⋮ |

FIG. 15

1200

| 1201 COPYING MACHINE ID | 1202 PART CODE | 1203 PART COUNTER | 1204 CONSUMED LEVEL |
|---|---|---|---|
| MXD2041B | 10000001 | 1534 | 2 |
| ⋮ | ⋮ | ⋮ | ⋮ |
| YPS5883A | 10000001 | 37148 | 15 |
| ⋮ | ⋮ | ⋮ | ⋮ |
| YPS5883A | 20000001 | 146225 | 13 |
| YPS5883A | 20000005 | 42451 | 14 |
| YPS5883A | 20000011 | 55307 | 19 |
| YPS5883A | 30000001 | 204891 | 33 |
| ⋮ | ⋮ | ⋮ | ⋮ |
| TGG934T1 | 10000002 | 20583 | 4 |
| TGG934T1 | 20000002 | 503810 | 50 |
| ⋮ | ⋮ | ⋮ | ⋮ |

IMAGE FORMING APPARATUS AND INFORMATION PROCESSING METHOD THEREOF

BACKGROUND OF THE INVENTION

1. Field of the Invention

The present invention relates to an image forming apparatus and an information processing method thereof and, more particularly, to a technique of calculating a consumed level for an image forming apparatus having a display unit and capable of communicating with a monitoring device for monitoring a plurality of image forming apparatuses.

2. Description of the Related Art

A mechanism is conventionally known, which detects a toner remaining amount in, e.g., a copying machine and outputs the detection result to the display unit of the copying machine or a computer in a remote site.

Japanese Patent Laid-open No. 10-032659 discloses a mechanism which places an order for a new consumable upon determining that it is going to run out, based on a detected remaining amount.

In the conventional technique, however, since calculation of the consumed levels of parts represented by consumables such as a toner is executed in the image forming apparatus main body, the accuracy is poor.

SUMMARY OF THE INVENTION

The present invention has been made in consideration of the above problem, and has as its object to enable to output information about the consumed level of a part of an image forming apparatus at an accuracy higher than before.

In order to solve the problem, an image forming apparatus according to the present invention capable of communicating, via the internet, with an external monitoring device for monitoring operating states of a plurality of image forming apparatuses, comprise: a storage unit adapted to detect an operating amount of a part included in the image forming apparatus and store information about the operating amount in relation to the part; an informing unit adapted to inform the external monitoring device of a request for acquiring a first consumed level of the part calculated by the external monitoring device, the request containing the information about the operating amount of the part; an acquiring unit adapted to acquire the first consumed level of the part and a value to be used to calculate a second consumed level of the part from the external monitoring device, as a response to the request for acquiring the first consumed level of the part sent by the informing unit; a calculation unit adapted to calculate the second consumed level of the part based on the information about the operating amount stored in the storage unit and the value acquired by the acquiring unit to be used to calculate the second consumed level of the part; and an output unit adapted to output the first consumed level in relation to the part when the acquiring unit has acquired the first consumed level of the part from the external monitoring device and output the calculated second consumed level in relation to the part when the acquiring unit cannot acquire the first consumed level of the part from the external monitoring device. The value to be acquired by the acquiring unit and used to calculate the second consumed level of the part is updated in the external monitoring device every time the external monitoring device acquires information about operating amount of the part from any one of the plurality of image forming apparatuses of which the operating statuses are monitored by the external monitoring device.

An information processing method according to the present invention in an image forming apparatus capable of communicating, via the internet, with an external monitoring device for monitoring operating states of a plurality of image forming apparatuses, comprises the steps of: detecting an operating amount of a part included in the image forming apparatus and storing information about the operating amount in relation to the part into a storage unit; informing the external monitoring device of a request for acquiring a first consumed level of the part calculated by the external monitoring device, the request containing the information about the operating amount of the part; acquiring the first consumed level of the part and a value to be used to calculate a second consumed level of the part from the external monitoring device, as a response to the request for acquiring the first consumed level of the part sent in the informing step; calculating the second consumed level of the part based on the information about the operating amount stored in the storage unit and the value acquired in the acquiring step to be used to calculate the second consumed level of the part; and outputting the first consumed level in relation to the part when the first consumed level of the part is acquired from the external monitoring device in the acquiring step or outputting the calculated second consumed level in relation to the part when the first consumed level of the part cannot be acquired from the external monitoring device in the acquiring step. The value to be acquired in the acquiring step and used to calculate the second consumed level of the part is updated in the external monitoring device every time the external monitoring device acquires information about operating amount of the part from any one of the plurality of image forming apparatuses of which the operation statuses are monitored by the external monitoring device.

A computer-readable storage medium according to the present invention which stores a program for implementing an information processing method in an image forming apparatus capable of communicating, via the internet, with an external monitoring device for monitoring operating states of a plurality of image forming apparatuses, the program causes a computer to execute the steps of: detecting an operating amount of a part included in the image forming apparatus and storing information about the operating amount in relation to the part into a storage unit; informing the external monitoring device of a request for acquiring a first consumed level of the part calculated by the external monitoring device, the request containing the information about the operating amount of the part; acquiring the first consumed level of the part and a value to be used to calculate a second consumed level of the part from the external monitoring device, as a response to the request for acquiring the first consumed level of the part sent in the informing step; calculating the second consumed level of the part based on the information about the operating amount stored in the storage unit and the value acquired in the acquiring step to be used to calculate the second consumed level of the part; and outputting the first consumed level in relation to the part when the first consumed level of the part is acquired from the external monitoring device in the acquiring step or outputting the calculated second consumed level in relation to the part when the first consumed level of the part cannot be acquired from the external monitoring device in the acquiring step. The value to be acquired in the acquiring step and used to calculate the second consumed level of the part is updated in the external monitoring device every time the external monitoring device acquires information about operating amount of the part from any one of the plurality of image forming apparatuses on which the operating statuses are monitored by the external monitoring device.

An image forming system according to the present invention comprises a plurality of image forming apparatuses, and an external monitoring device which can communicate with the plurality of image forming apparatuses via the internet and monitors operating states of the plurality of image forming apparatuses. Each of the image forming apparatuses comprises: a first storage unit adapted to detect an operating amount of a part included in the image forming apparatus and store information about the operating amount in relation to the part; an informing unit adapted to inform the external monitoring device of a request for acquiring a first consumed level of the part calculated by the external monitoring device, the request containing the information about the operating amount of the part; an acquiring unit adapted to acquire the first consumed level of the part and a value to be used to calculate a second consumed level of the part from the external monitoring device, as a response to the request for acquiring the first consumed level of the part sent by the informing unit; a calculation unit adapted to calculate the second consumed level of the part based on the information about the operating amount stored in the first storage unit and the value acquired by the acquiring unit to be used to calculate the second consumed level of the part; and an output unit adapted to output the first consumed level in relation to the part when the acquiring unit has acquired the first consumed level of the part from the external monitoring device or output the calculated second consumed level in relation to the part when the acquiring unit cannot acquire the first consumed level of the part from the external monitoring device. The external monitoring device comprises: a second storage unit adapted to store the information about operating amount of the part included in the image forming apparatus, which is contained in the request sent from each of the plurality of image forming apparatus, in relation to the image forming apparatus and the part; an updating unit adapted to update the value to be used by the calculation unit of the image forming apparatus to calculate the second consumed level of the part upon acquiring the information about operating amount of the part from any one of the plurality of image forming apparatuses; and a transmission unit adapted to calculate the first consumed level of the part using a calculating expression for calculating the first consumed level corresponding to the part included in the image forming apparatus and transmit the calculated first consumed level and the value to be used to calculate the second consumed level of the part, which is updated by the updating unit, to the image forming apparatus, as a response to the request sent from the image forming apparatus.

A method in an image forming system comprising a plurality of image forming apparatuses, and an external monitoring device which can communicate with the plurality of image forming apparatuses via the internet and monitors operating states of the plurality of image forming apparatuses is also provided. Each of the image forming apparatuses comprises the steps of: detecting an operating amount of a part included in the image forming apparatus and storing information about the operating amount in correction to the part into a first storage unit; informing the external monitoring device of a request for acquiring a first consumed level of the part calculated by the external monitoring device, the request containing the information about the operating amount of the part; acquiring the first consumed level of the part and a value to be used to calculate a second consumed level of the part from the external monitoring device, as a response to the request for acquiring the first consumed level of the part sent in the informing step; calculating the second consumed level of the part based on the information about the operating amount stored in the first storage unit and the value acquired in the acquiring step to be used to calculate the second consumed level of the part; and outputting the first consumed level in relation to the part when the first consumed level of the part is acquired from the external monitoring device in the acquiring step and outputting the calculated second consumed level in relation to the part when the first consumed level of the part cannot be acquired from the external monitoring device in the acquiring step. The external monitoring device comprises the steps of: storing the information about operating amount of the part included in the image forming apparatus, which is contained in the request sent from each of the plurality of image forming apparatus, in relation to the image forming apparatus and the part into a second storage unit; updating the value to be used in the calculation step of the image forming apparatus to calculate the second consumed level of the part upon acquiring the information about operating amount of the part from any one of the plurality of image forming apparatuses; and calculating the first consumed level of the part using a calculating expression for calculating the first consumed level corresponding to the part included in the image forming apparatus and transmitting the calculated first consumed level and the value to be used to calculate the second consumed level of the part, which is updated in the updating step, to the image forming apparatus, as a response to the request sent from the image forming apparatus.

According to present invention, it is possible to output information about the consumed level of a part of an image forming apparatus at an accuracy higher than before.

It is also possible to output information about the consumed level of a part independently of the state of communication with a monitoring device for monitoring the operating states of a plurality of image forming apparatuses.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 7 is a view showing an example of the arrangement of a part counter managing table managed by the part counter managing portion of the copying machine shown in FIG. 6;

FIG. 9 is a view showing an example of the data structure of a part counter transmission command used between the functional blocks of the copying machine according to the embodiment;

FIGS. 10A and 10B are views showing an example of SOAP data representing the part counter transmission command according to the embodiment;

FIGS. 11A and 11B are views showing an example of SOAP data representing a response to the part counter transmission command according to the embodiment;

FIG. 14 is a view showing an example of the arrangement of a part managing master table managed by the part information managing portion of the monitoring server shown in FIG. 13;

FIG. 15 is a view showing an example of the arrangement of a part consumed level managing table managed by the part information managing portion of the monitoring server shown in FIG. 13;

DESCRIPTION OF THE EMBODIMENTS

An embodiment of the present invention will now be described with reference to the accompanying drawings. In the following embodiment, monitoring of part consumed levels and management of information about consumed levels will be explained using an image forming apparatus such as a copying machine or a printer as an example. However, the present invention is applicable not only to an image forming apparatus but also to a system having a monitoring device for monitoring a plurality of image forming apparatuses via communication.

<Example of Configuration of Image Forming System of Embodiment>

Figure 1:
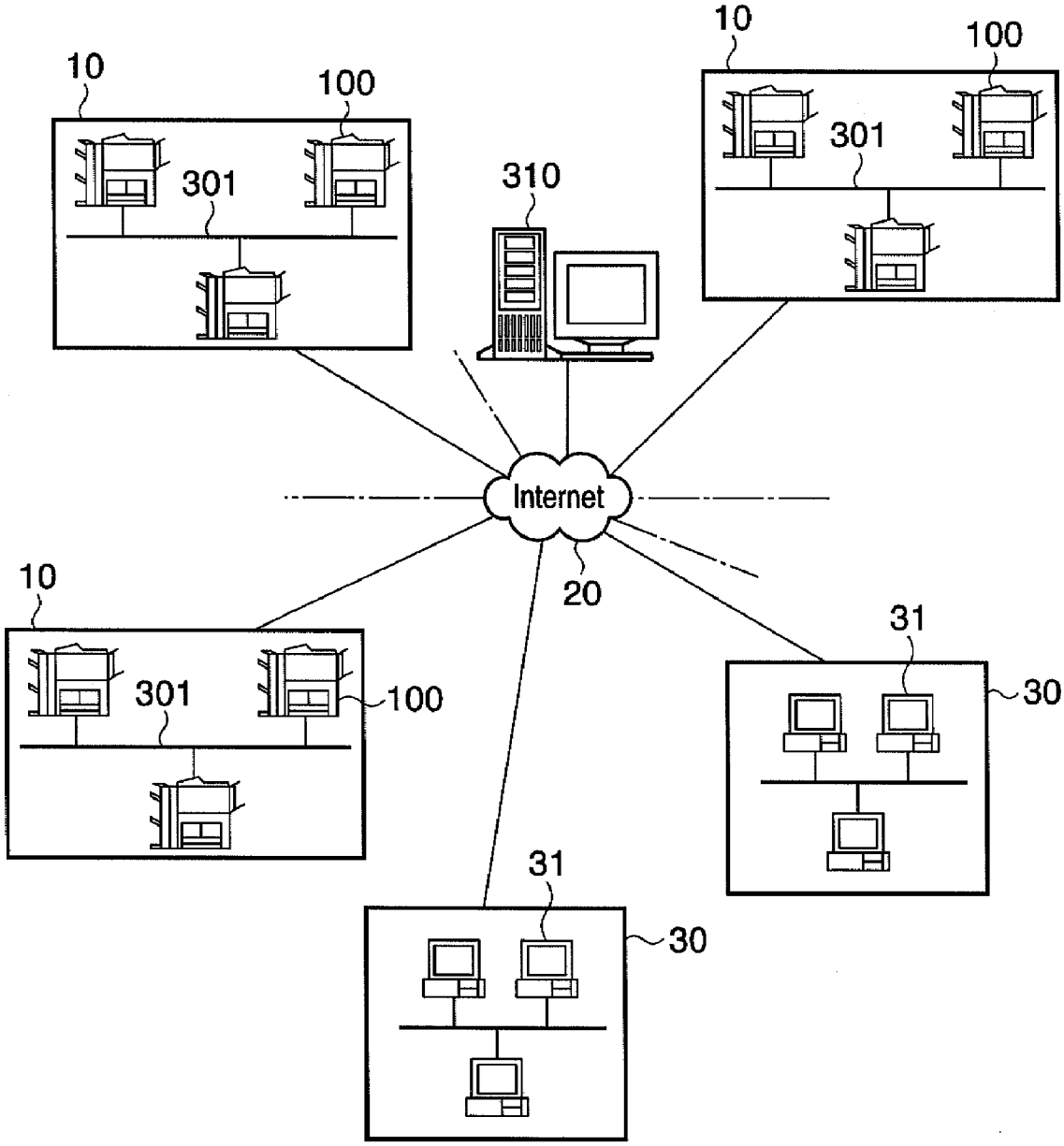
FIG. 1 is a view showing an example of a system configuration according to the embodiment in which a monitoring server and customer intranet environments are connected via the Internet.

FIG. 1 is a view showing an example of an entire image forming system configuration according to the embodiment.

Referring to FIG. 1, a monitoring server 310 corresponds to a monitoring device for collectively managing the operating states of image forming apparatuses. The monitoring server 310 communicates with an image forming apparatus in a customer intranet or a personal computer (to be referred to as a PC hereinafter) in a vendor intranet via the Internet 20.

Reference numeral 10 denotes a customer intranet environment. The customer intranet environment 10 includes a plurality of image forming apparatuses 100 connected via a LAN 301. Each image forming apparatus communicates with the monitoring server 310 via the Internet 20.

Reference numeral 30 denotes a vendor intranet environment. The vendor intranet environment 30 includes at least one PC 31. Each PC 31 communicates with the monitoring server 310 via the Internet 20.

The image forming apparatus 100 sends, to the monitoring server 310 via the Internet 20, operation information such as operation mode settings, print counter value, part counter values representing the operating amounts of the respective parts, and operating log, and fault information such as a service call, jam, and alarm. The image forming apparatus 100 also receives various requests (e.g., information acquiring request, communication schedule setting request, and firmware update request) from the monitoring server 310. In this example, SOAP (Simple Object Access Protocol) is used for this communication.

The image forming apparatus 100 to be described here includes a digital multifunction copying machine that combines a print function, facsimile function, and copy function, a printer, a scanner, and a facsimile apparatus. In the following description, the image forming apparatus 100 will be specialized to a digital multifunction copying machine (to be referred to as a copying machine hereinafter) 100.

<Example of Hardware Configuration of Copying Machine of Embodiment>

Figure 2:
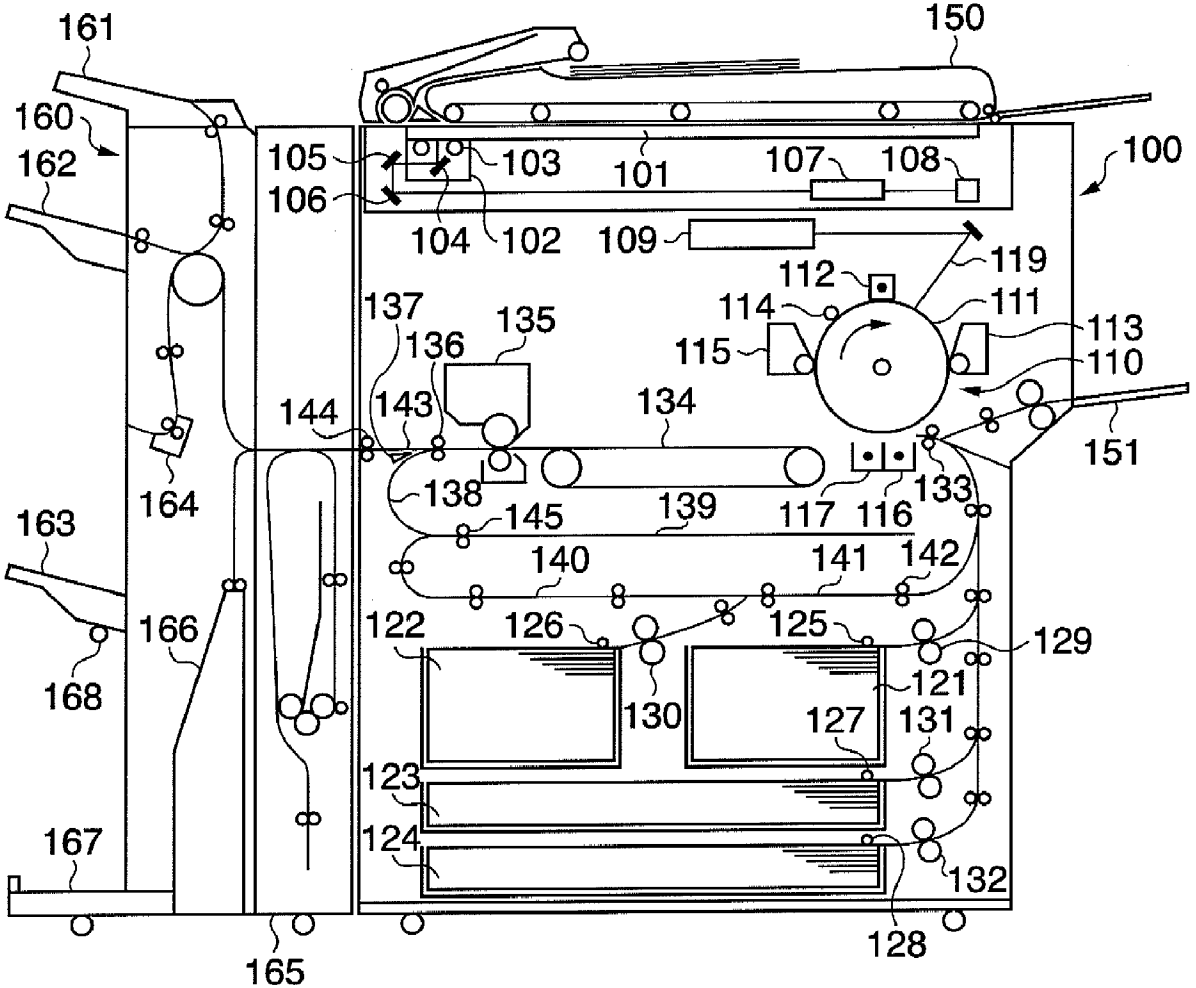
FIG. 2 is a sectional view showing the internal structure of a copying machine according to the embodiment.

FIG. 2 is a sectional view showing an example of the hardware configuration of the copying machine 100 serving as an image forming apparatus.

Referring to FIG. 2, reference numeral 150 denotes an automatic document feeder (DF); and 102, a scanner. The scanner 102 includes a document illumination lamp 103 and a scan mirror 104.

The automatic document feeder 150 sequentially feeds document pages onto a platen glass 101 one by one from the last page and discharges the document pages after reading them. The scanner 102 driven by a motor (not shown) reciprocally scans each document page fed onto the platen glass 101. Light reflected by the document passes through a lens 107 via the scan mirrors 104 to 106 and forms an image on a CCD sensor in an image sensor unit 108. An exposure control unit 109 including a laser and a polygon scanner irradiates a photosensitive drum 111 with a laser beam 119 modulated based on an image signal which is converted into an electrical signal by the image sensor unit 108 and subjected to predetermined image processing.

A primary charger 112, developer 113, transfer charger 116, separation charger 117, pre-exposure lamp 114, and cleaner device 115 are arranged around the photosensitive drum 111. In an image forming unit 110, the photosensitive drum 111 is rotated by a motor (not shown) in the direction of an arrow. The primary charger 112 charges the photosensitive drum 111 to a desired potential. The exposure control unit 109 irradiates the photosensitive drum 111 with the laser beam 119 to form an electrostatic latent image on it. The developer 113 develops the electrostatic latent image formed on the photosensitive drum 111 and visualizes it as a toner image.

On the other hand, pickup rollers 125 to 128 feed a transfer sheet from a right cassette deck 121, left cassette deck 122, upper cassette 123, or lower cassette 124. Feed rollers 129 to 132 and registration rollers 133 feed the transfer sheet to a transfer belt 134. In this process, the transfer charger 116 transfers the visualized toner image to the transfer sheet. The copying machine also has a multiple manual feed tray 151 capable of storing 100 transfer sheets.

The cleaner device 115 removes the residual toner from the photosensitive drum 111 after toner image transfer. The pre-exposure lamp 114 erases the residual charges from the photosensitive drum 111. The separation charger 117 separates the transfer sheet after transfer from the photosensitive drum 111. The transfer belt 134 conveys the sheet to a fixing device 135. The fixing device 135 fixes the toner image by pressure and heat. Discharge rollers 136 discharge the transfer sheet outside the copying machine 100.

A discharge flapper 137 switches the path to a conveyance path 138 or discharge path 143. A lower conveyance path 140 reverses, via a reversing path 139, the transfer sheet sent from the discharge rollers 136 and guides it to a re-feed path 141. A transfer sheet fed from the left cassette deck 122 via the feed rollers 130 is also guided to the re-feed path 141. Re-feed rollers 142 re-feed the transfer sheet to the image forming unit 110. Discharge rollers 144 arranged near the discharge flapper 137 discharge, outside the copying machine, the transfer sheet switched to the side of the discharge path 143 by the discharge flapper 137.

In a double-side print (double-side copy) mode, the discharge flapper 137 moves up to guide the transfer sheet after copy to the re-feed path 141 via the conveyance path 138, reversing path 139, and lower conveyance path 140. At this time, reversing rollers 145 completely draw out the trailing edge of the transfer sheet from the conveyance path 138. The transfer sheet enters the reversing path 139 without being released from the reversing rollers 145. Then, the reversing rollers 145 rotate in the reverse directions to feed the transfer sheet to the lower conveyance path 140.

To reverse the transfer sheet and discharge it from the copying machine 100, the discharge flapper 137 moves up, and the reversing rollers 145 make the transfer sheet enter the reversing path 139 while keeping its trailing edge in the conveyance path 138. Then, the reversing rollers 145 rotate in the reverse directions to turn the transfer sheet upside down and feed it to the side of the discharge rollers 144.

A discharge processing apparatus 160 aligns and binds transfer sheets discharged from the copying machine 100. This apparatus stacks the transfer sheets discharged one by one on a process tray 164 and aligns them. When image formation of one copy is completed, the apparatus staples the bundle of transfer sheets and discharges it to a discharge tray 162 or 163.

A motor (not shown) controls the vertical movement of the discharge tray 163. The discharge tray 163 moves to the position of the process tray 164 before the start of image forming operation. As the discharged transfer sheets are stacked, the discharge tray 163 moves to make the surface of the uppermost sheet match with the position of the process tray 164. A tray lower limit sensor 168 detects the lower limit of the discharge tray 163. The lower limit is detected when about 2,000 transfer sheets are stacked on the discharge tray 163.

Interleaving paper sheets to be inserted between the discharged transfer sheets are stacked on a paper tray 161. A Z-folding apparatus 165 z-folds the discharged transfer sheets. A bookbinding apparatus 166 performs bookbinding by folding some of the discharged transfer sheets at the center and stapling them. A bundle of sheets bound into a book is discharged to a discharge tray 167.

Various kinds of sensors (not shown) are arranged at various places in the copying machine to detect the toner level, document jam, remaining transfer sheet amount, transfer sheet jam, remaining consumable amounts related to development, document illumination lamp burnout, and various faults generated in the copying machine 100.

A control unit 180 which is not illustrated in FIG. 2 is arranged to control the operation of the entire apparatus.

(Example of Arrangement of Control Unit of Copying Machine of Embodiment)

Figure 3:
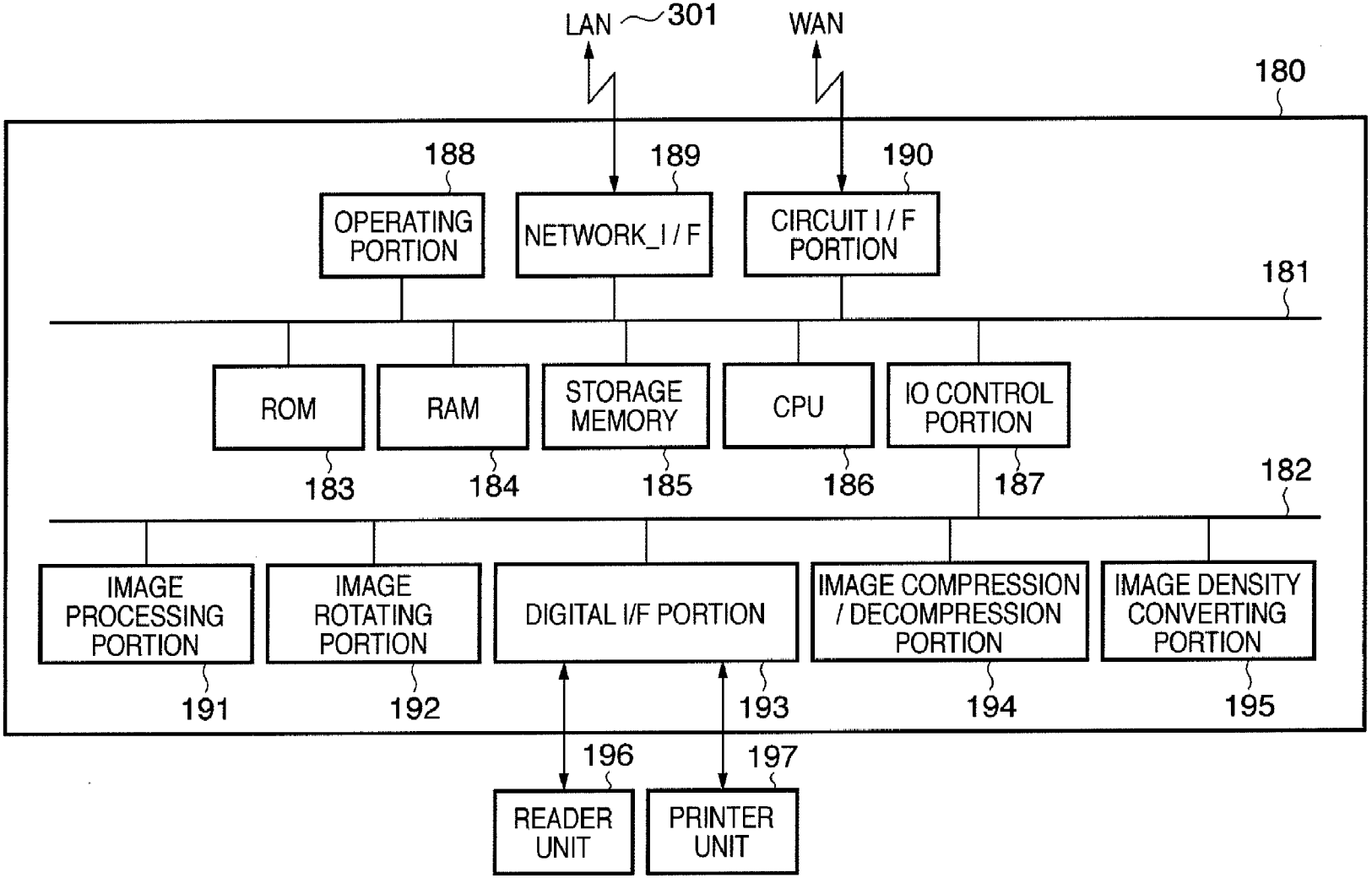
FIG. 3 is a block diagram showing an example of the hardware configuration of the control unit of the copying machine according to the embodiment.

FIG. 3 is a block diagram showing an example of the arrangement of the control unit 180 of the copying machine 100. The constituent elements of the control unit 180 are connected to a system bus 181 and an image bus 182.

A ROM 183 stores the control program of the copying machine 100. A CPU 186 executes the control program (FIGS. 8A and 8B, 19A and 19B). A RAM 184 serves as a work memory area to execute a computer program and also serves as an image memory to temporarily store image data.

A storage memory 185 is a nonvolatile memory corresponding to a first storage unit. The storage memory 185 stores various operation mode settings which must be held even after the restart of the copying machine 100, print counter value, part counter values representing the operating amounts of parts, operating log, and fault information such as an error requiring service call, jam, and alarm. The storage memory 185 stores, e.g., a part counter managing table 600 to be described later.

A Network_I/F 189 is an interface portion which is connected to the LAN 301 to communicate with the monitoring server 310 via the Internet 20. A circuit I/F portion 190 is connected to an ISDN or a public telephone network to transmit/receive data to/from a terminal in a remote site via an ISDN_I/F, modem, or NCU (Network Control Unit) under the control of a communication control program in the ROM 183. Facsimile transmission/reception is also done using the circuit I/F portion 190.

An operating portion 188 incorporates a display unit and a key input unit, which are controlled by the CPU 186. The operator inputs various setting instructions and operation/stop instructions related to reading by the scanner or print output via the key input unit. The above-described constituent elements are arranged on the system bus 181.

An IO control portion 187 serves as a bus bridge to connect the system bus 181 to the image bus 182 that transfers image data at a high speed. The image bus 182 is formed from a PCI bus or IEEE1394. The following devices are arranged on the image bus 182.

A digital I/F portion 193 connects the control unit 180 to a reader unit 196 or a printer unit 197 of the copying machine 100 to convert the synchronous/asynchronous system of image data. Information detected by the above-described various sensors located at various places in the reader unit 196 or printer unit 197 is supplied to the system bus 181 via the digital I/F portion 193 and the IO control portion 187. An image processing portion 191 corrects, processes, and edits input and output image data. An image rotating portion 192 rotates image data. An image compression/decompression portion 194 executes JPEG compression/decompression for multilevel image data and JBIG/MMR/MR/MH compression/decompression for binary image data. An image density converting portion 195 executes, e.g., resolution conversion of output image data.

The CPU 186 executes the control program and reads out various operation mode settings, print counter value, part counter values representing the operating amounts of parts, operating log, and fault information such as an error requiring service call, jam, and alarm from the storage memory 185. The CPU 186 converts the pieces of information into an XML data format (to be described later) and transmits them to the monitoring server 310 via the Network_I/F 189.

At this time, the CPU 186 classifies the acquired information roughly into two types and transmits them to the monitoring server 310 at different timings. One type includes information about faults such as an error requiring service call, jam, and alarm. These pieces of information require immediacy. Hence, upon acquiring information, the CPU 186 immediately transmits it to the monitoring server 310. The other type includes information such as various operation mode settings, print counter value, part counter values representing the operating amounts of parts, and operating log. The CPU 186 periodically transmits these pieces of information to the monitoring server 310 in accordance with a predetermined communication schedule.

<Example of Hardware Configuration of Monitoring Server of Embodiment>

Figure 4:
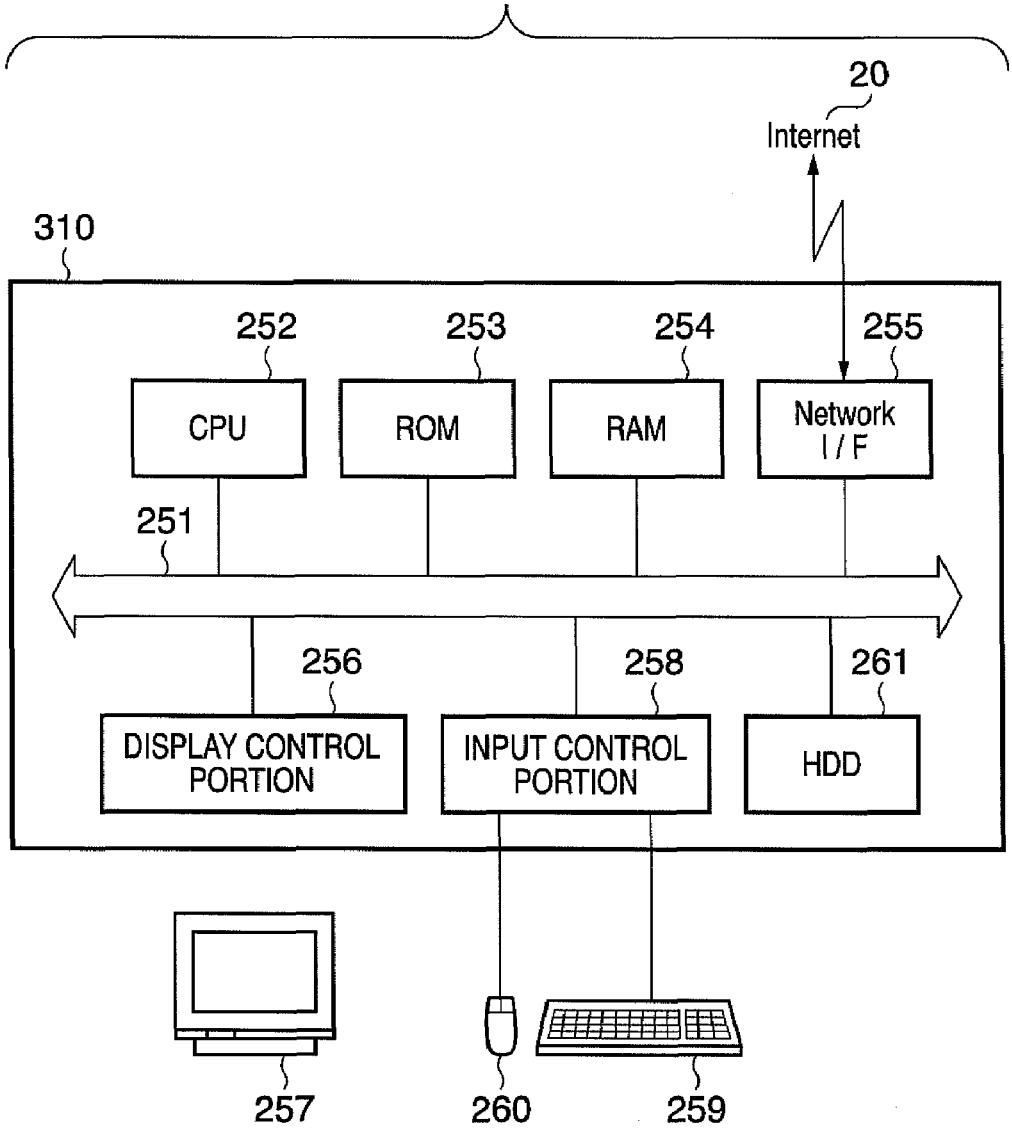
FIG. 4 is a block diagram showing an example of the hardware configuration of the monitoring server according to the embodiment.

FIG. 4 is a block diagram showing an example of the hardware configuration of the monitoring server 310.

The monitoring server 310 has a CPU 252 for controlling the overall monitoring server 310. The monitoring server 310 also has a ROM 253 that is a read only memory which stores a boot program necessary for system activation. The monitoring server 310 further includes a RAM 254 serving as a work memory necessary for computer program execution by the CPU 252. The monitoring server 310 also includes a Network_I/F portion 255 which communicates with a site monitoring device 200 or a PC in a vendor intranet via the Internet 20. The monitoring server 310 also has a display control portion 256, an input control portion 258, and an HDD 261 which stores programs to be executed by the CPU 252 and operation information received from the copying machine 100. The above described elements are connected to a system bus 251.

A display device 257 is connected to the display control portion 256. Input devices 259 and 260 are connected to the input control portion 258. The operator who manages the monitoring server 310 confirms the operating state of the monitoring server 310 or inputs an operation instruction via these input and output devices.

The monitoring server 310 always receives information transmitted from the copying machine 100 to the Network_I/F portion 255 via the Internet 20, as described above. The monitoring server 310 parses the XML data of the received information and stores it in the HDD 261 serving as a second storage unit.

A WWW (World Wide Web) server program runs in the monitoring server 310 to display the information stored in the HDD 261 as a Web screen. This allows, e.g., a serviceman of a vendor to access the WWW server on the monitoring server 310 using a Web browser on a PC in the vendor intranet environment 30. It is therefore possible to browse the information stored in the HDD 261 of the monitoring server 310 from the vendor intranet environment 30.

<Example of Periodical Communication Process of Embodiment>

(Outline of Periodical Transmission/Reception Sequence)

Figure 5:
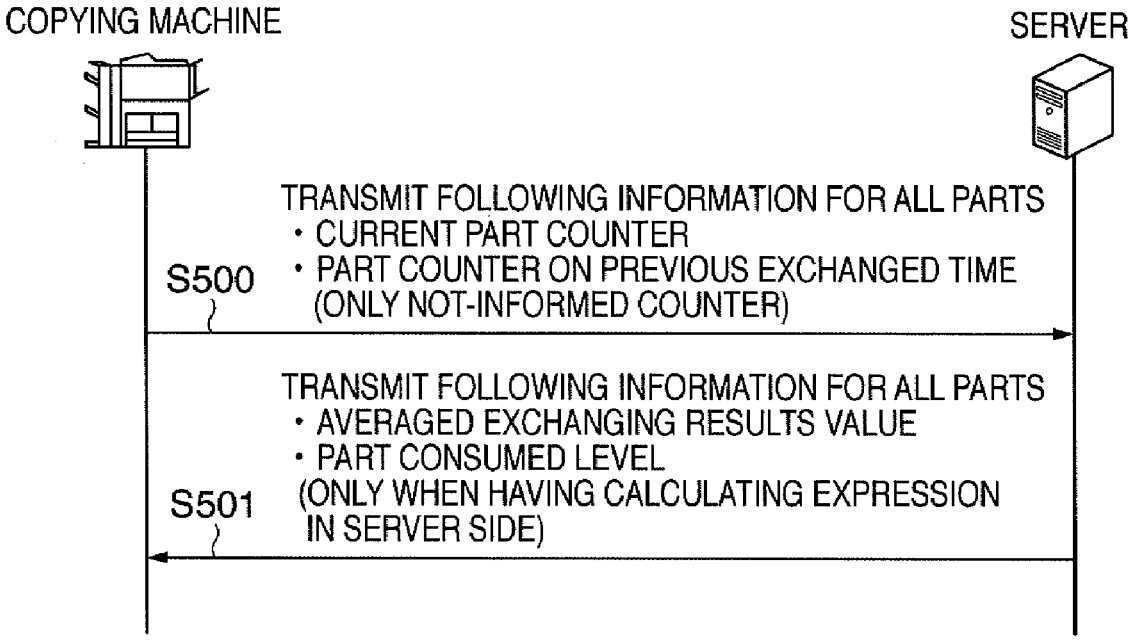
FIG. 5 is a sequence chart showing an example of the sequence of periodical part counter communication between the copying machine and the monitoring server according to the embodiment.

FIG. 5 is a sequence chart showing a periodical part counter value information transmission/reception sequence between the copying machine 100 and the monitoring server 310 according to the present invention.

The copying machine 100 transmits part counter information to the monitoring server 310 at each predetermined communication start timing (S500). More specifically, the copying machine 100 transmits the part codes and current part counter values of all parts, and part counter values on a previous exchanged time related to parts for which a flag column 604 indicating informing of counter on a previous exchanged time has a value "OFF", all of which are stored in the above-described part counter managing table 600. This process corresponds to the process of an informing unit.

As a response to the transmission, the monitoring server 310 returns averaged exchanging results values and part consumed levels (to be described later) to the copying machine 100 (S501). Upon receiving the values, the copying machine 100 writes them in an averaged results value column 605 and a consumed level column 606 of the part counter managing table 600. This process corresponds to the process of an acquiring unit.

<Example of Periodical Communication Process on Copying Machine Side>

A process associated with the periodical transmission/reception sequence on the side of the copying machine 100 will be described in more detail with reference to FIGS. 6 to 12.

Figure 6:
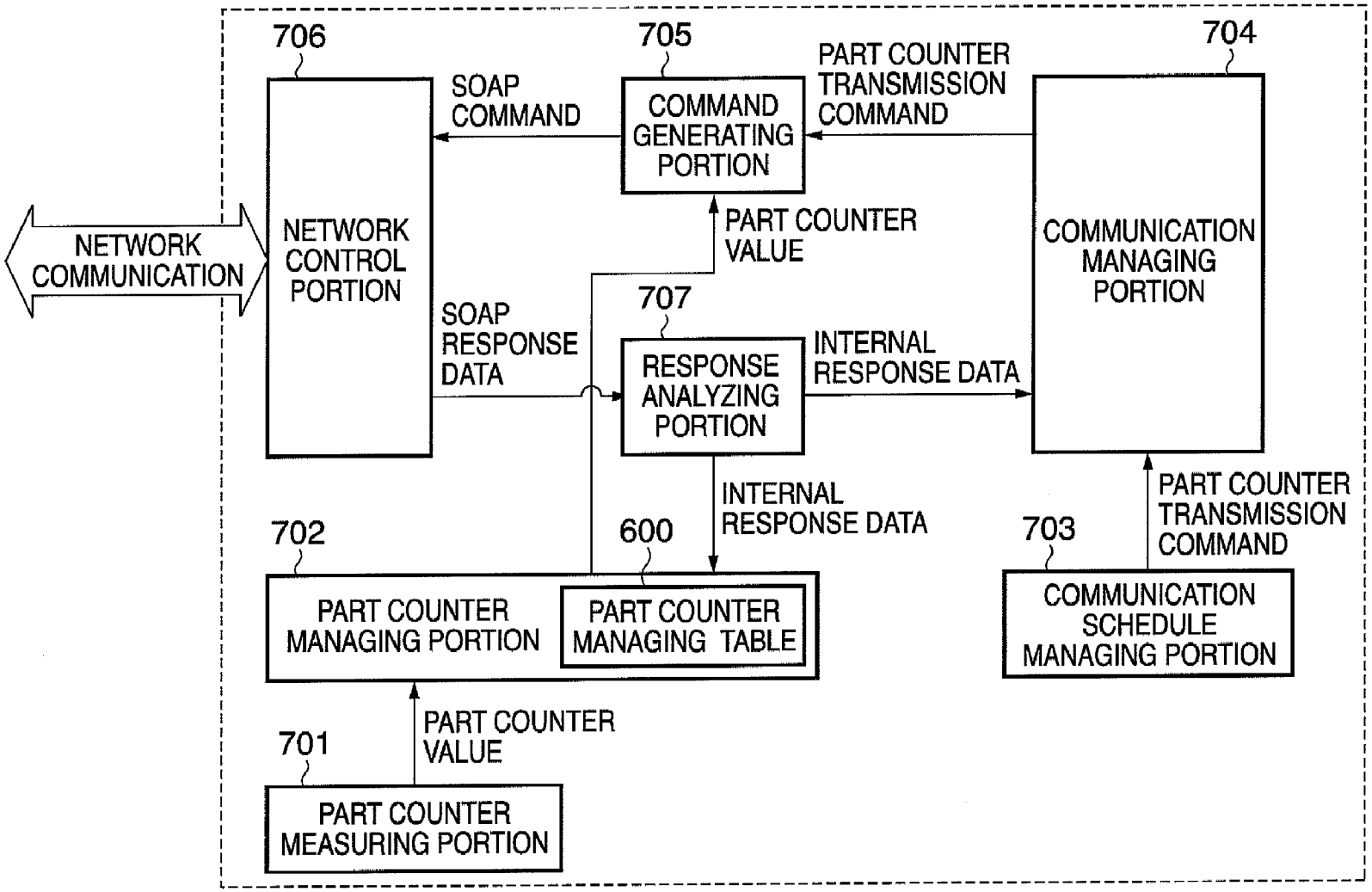
FIG. 6 is a block diagram showing an example of the functional arrangement of the copying machine in the periodical part counter communication according to the embodiment.

FIG. 6 shows examples of the functional blocks of the copying machine 100 associated with the periodical transmission/reception sequence and the relationship between them. The entity of the functional blocks is a control program stored in the ROM 183. The functional blocks exchange data and control commands with each other by message communication via the RAM 184.

Figure 8A:
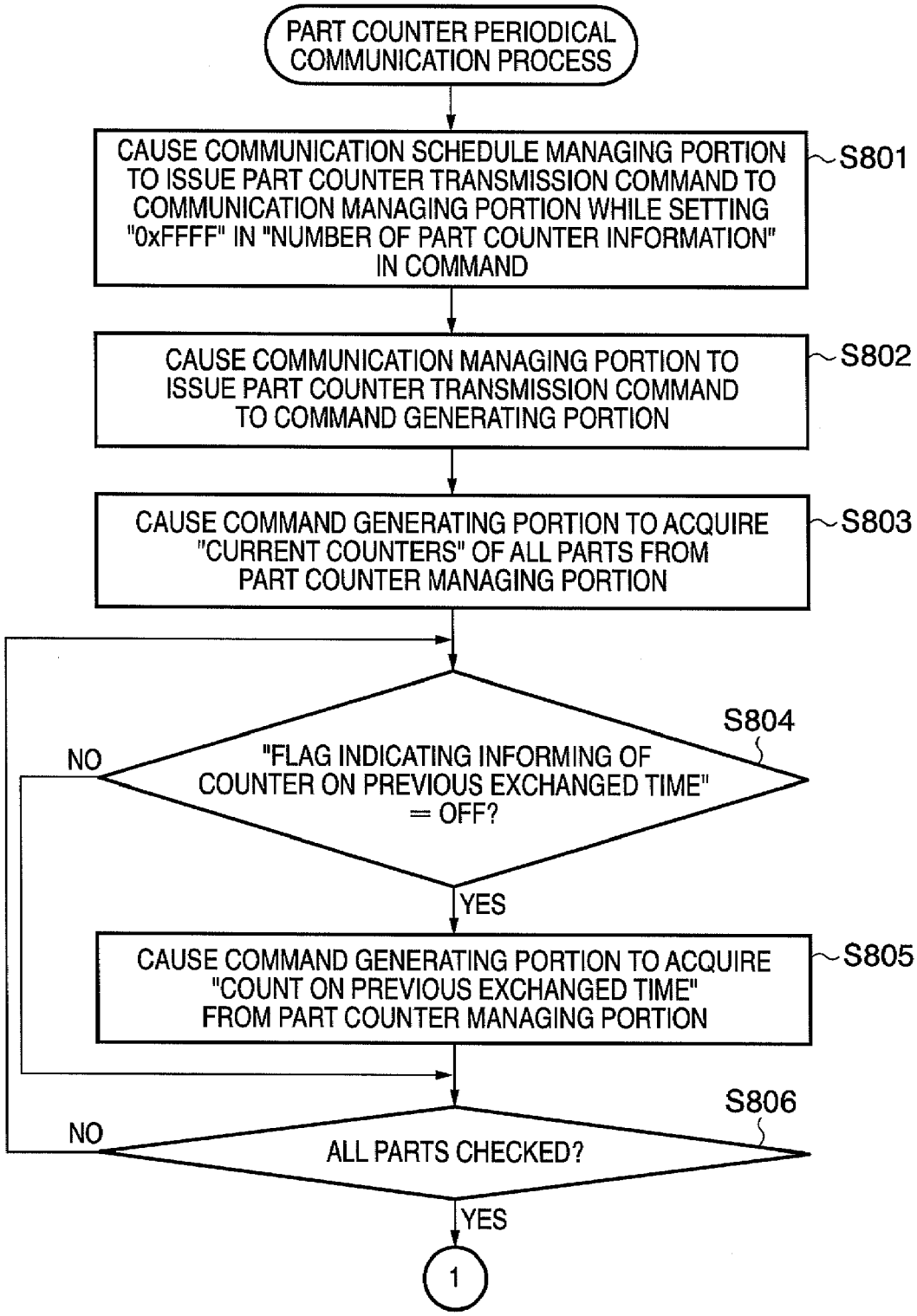
FIGS. 8A and 8B are flowcharts illustrating an example of the process procedure of the copying machine in the periodical part counter communication according to the embodiment.
Figure 8B:
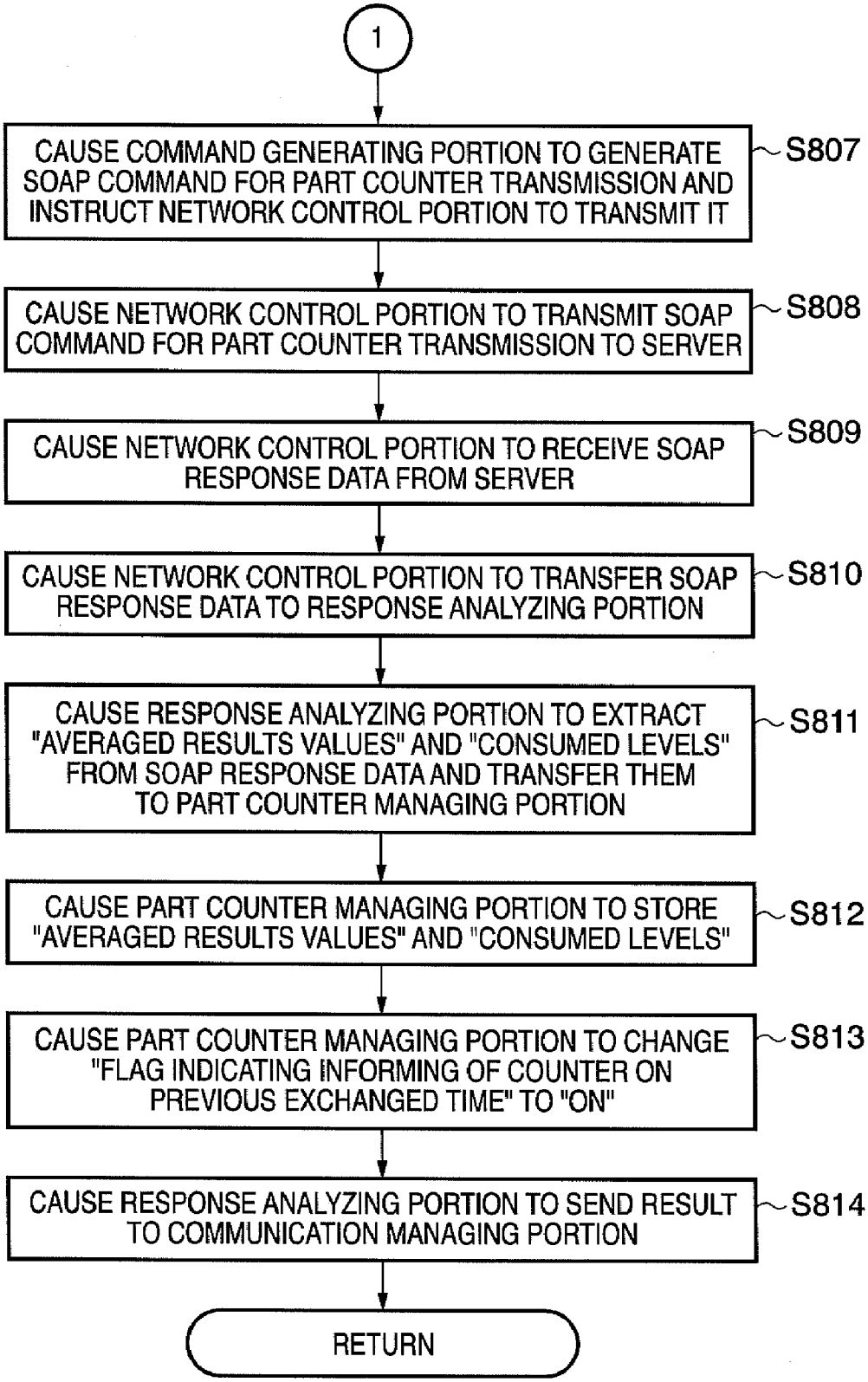

FIGS. 8A and 8B are flowcharts illustrating an example of the process procedure of the functional blocks of the copying machine 100 associated with the periodical transmission/reception sequence. Functional elements in FIG. 6 and execution of processing in FIGS. 8A and 8B are accomplished by the CPU 186 in FIG. 3 executing programs stored in memory.

The periodical communication process on the copying machine side will be described below with reference to FIGS. 6, 8A and 8B.

A part counter measuring portion 701 in FIG. 6 always counts the operating amounts of the parts in an operation such as copy or printing and transfers them to a part counter managing portion 702, as described above. When the user exchanges a part and instructs to reset the part counter value from the operating portion 188, the part counter measuring portion 701 transfers the current operating amount of the part to the part counter managing portion 702 as a counter value on a previous exchanged time. The part counter managing portion 702 has the part counter managing table 600.

(Example of Arrangement of Part Counter Managing Table 600)

FIG. 7 is a view showing an example of the arrangement of the part counter managing table 600 so as to schematically illustrate a state in which pieces of information about part counter values are stored in the storage memory 185 of the copying machine 100. The part counter managing table 600 corresponds to an operating amount storage unit and a consumed level storage unit. A method of managing information about part counter values on the side of the copying machine 100 according to the embodiment will be described with reference to FIG. 7.

Exchangeable parts used in the copying machine 100 are assigned in advance predetermined numbers (to be referred to as part codes hereinafter) to uniquely specify them in accordance with the types. The part codes are stored in a part code column 601 of the part counter managing table 600. The CPU 186 counts the operating amounts of the parts in an operation such as copy or printing and writes and stores them in a current count column 602 as needed.

When the user exchanges a part and instructs to reset the part counter value representing the number of operations after exchange of the part from the operating portion 188, the CPU 186 writes, in a count column 603 on a previous exchanged time, the counter value of the part in the current count column 602. Simultaneously, the CPU 186 writes "0" in the current count column 602. The CPU 186 also writes "OFF" in the flag column 604 indicating informing of counter on a previous exchanged time. At the shipping of the copying machine, the flag indicating informing of counter on a previous exchanged time is "ON" for all parts.

The averaged results value column 605 and the consumed level column 606 store the averaged results values and part consumed levels (to be described later) of the respective part codes acquired from the monitoring server 310. The initial value of the averaged results value is an assumed service life value predetermined for each part code at the time of production. The initial value of the consumed level is "0".

The part counter managing portion 702 in FIG. 6 writes these pieces of information received from the part counter measuring portion 701 in the current count column 602, the count column 603 on a previous exchanged time, and the flag column 604 indicating informing of counter on a previous exchanged time of the part counter managing table 600.

A communication schedule managing portion 703 in FIG. 6 manages the above-described predetermined communication start timing. At the predetermined timing, the communication schedule managing portion 703 issues a part counter transmission command to a communication managing portion 704 in step S801 in FIG. 8A.

(Example of Part Counter Transmission Command)

FIG. 9 schematically shows the contents of the part counter transmission command. A sequence number 1501 is added to the start of the command. The communication managing portion 704 employs and sets a unique sequence number. A command code representing part counter transmission is set in a command code 1502. A value "0xFFFF" indicating transmission of all pieces of part counter information is set in a number 1503 of part counter information. No values are set in a part code 1504, a part counter value 1505, and a counter value 1506 on a previous exchanged time.

Upon receiving the part counter transmission command, the communication managing portion 704 employs and sets a unique sequence number at the start of the command and issues the part counter transmission command to a command generating portion 705 in step S802.

In step S803, the command generating portion 705 recognizes that "0xFFFF" is set in the number 1503 of part counter information of the part counter transmission command. The command generating portion 705 reads out the current part counter values of all parts in the part counter managing table 600 via the part counter managing portion 702. In steps S804 to S806, the command generating portion 705 also reads out part counter values on a previous exchanged time related to parts for which the flag indicating informing of counter on a previous exchanged time is "OFF" in the part counter managing table 600.

In step S807, the command generating portion 705 generates a SOAP command based on these readout part counter values and sends it to a Network control portion 706 together with the sequence number in the part counter transmission command.

In step S808, the Network control portion 706 transmits the SOAP command representing part counter transmission to the monitoring server 310.

(Example of Soap Command)

FIGS. 10A and 10B show an example of data in the SOAP command transmitted in step S808.

Pieces of information of part counter values are described in a range surrounded by "<env:Envelope>" tags. A value surrounded by "<ns:copying machine ID>" tags represents a number assigned to each copying machine 100 in advance to uniquely specify it. The information of the part counter value of one part is described in a range surrounded by "<item xsi:type="ns:part counter">" tags. The "<item xsi:type="ns:part counter">" tags are repeated in accordance with the number of parts of the transmission target of the copying machine 100, thereby describing the pieces of information of the part counter values of a plurality of parts.

A value surrounded by "<ns:part code xsi:type="xsd:long">" tags in the range surrounded by the "<item xsi:type="ns:part counter">" tags represents a part code to uniquely specify each part. A value surrounded by "<ns:part counter value xsi:type="xsd:long">" tags is a part counter value representing the operating amount of the part at the time of data transmission. A value surrounded by "<ns:part counter value on a previous exchanged time xsi:type="xsd:long">" tags is a part counter value on a previous exchanged time of the part.

Upon receiving the SOAP command, the monitoring server 310 processes the SOAP command from the copying machine 100 in accordance with a process sequence to be described later and returns the process result to the copying machine 100 as a response.

(Example of Soap Response Data)

FIGS. 11A and 11B show an example of SOAP response data.

The response data contains pieces of information about parts managed on the side of the monitoring server 310, which are described in a range surrounded by "<env:Envelope>" tags. A copying machine ID designated by the SOAP command sent from the copying machine 100 is directly described as a value surrounded by "<ns:copying machine ID>" tags. Information of a part is described in a range surrounded by "<item xsi:type="ns:part counter">" tags. The "<item xsi:type="ns:part counter">" tags are repeated in accordance with the number of parts designated in the SOAP command by the copying machine 100, thereby describing the pieces of information of all designated parts.

A part code designated in the SOAP command sent from the copying machine 100 is directly described as a value surrounded by "<ns:part code xsi:type="xsd:long">" tags in the range surrounded by the "<item xsi:type="ns:part counter">" tags. A value representing a part consumed level calculated on the side of the monitoring server 310 is described as a value surrounded by "<ns:consumed level xsi:type="xsd:short">" tags. An averaged market results service life value of the part calculated on the side of the monitoring server 310 is described as a value surrounded by "<ns:averaged results value xsi:type="xsd:long">" tags.

In step S809, the Network control portion 706 receives the response data from the monitoring server 310. In step S810, the Network control portion 706 transfers the response data to a response analyzing portion 707 together with the sequence number.

The response analyzing portion 707 parses the received response data to extract the number of part information, part codes, part consumed levels, and averaged results values and generates internal response data. More specifically, a command code representing a part counter transmission response is set in a command code 1602. The number of part information extracted from the response data is set in a number 1603 of part counter information. The part codes, part consumed levels, and averaged results values extracted from the response data are set in a part code 1604, consumed level 1605, and averaged results value 1606 repeatedly in accordance with the number of part information. In step S811, the response analyzing portion 707 transfers the internal response data to the part counter managing portion 702.

In step S812, the part counter managing portion 702 sets the averaged results values and part consumed levels in the response data in the averaged results value column 605 and consumed level column 606 associated with the parts in the part counter managing table 600. In step S813, the part counter managing portion 702 writes "ON" for all records for which the flag column 604 indicating informing of counter on a previous exchanged time has a value "OFF". In step S814, the response analyzing portion 707 transfers the internal response data to the communication managing portion 704. The process associated with the periodical transmission/reception sequence on the side of the copying machine 100 is thus ended.

(Example of Internal Response Data)

Figure 12:
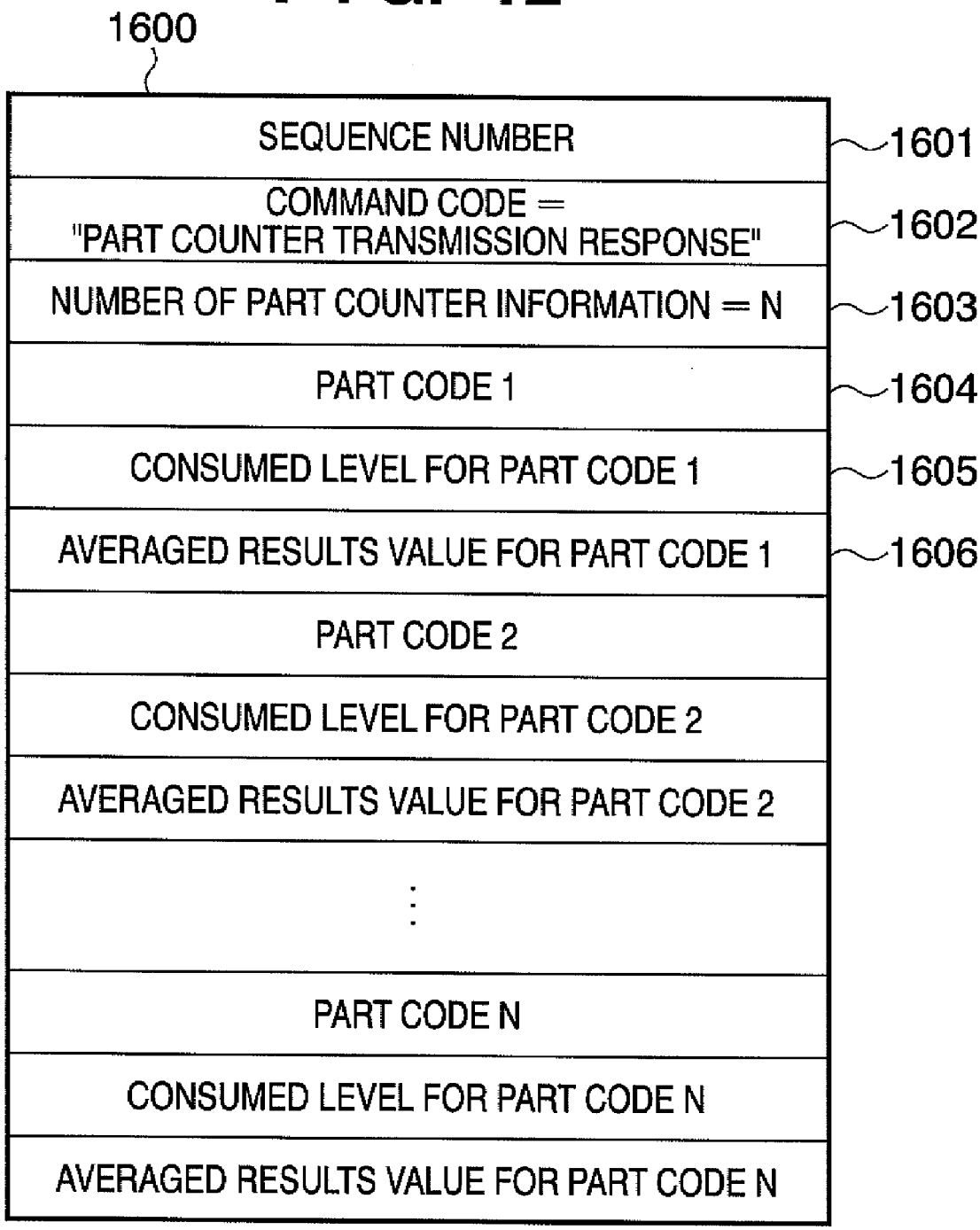
FIG. 12 is a view showing an example of the data structure of a response to the part counter transmission command used between the functional blocks of the copying machine according to the embodiment.

FIG. 12 schematically shows the above-described internal response data generated by the response analyzing portion 707.

The same number as the sequence number set in the above-described part counter transmission command is set in a sequence number 1601 at the start of the data. A command code representing a part counter transmission response is set in the command code 1602. The number of part counter information contained in the response data received from the monitoring server 310 is set in the number 1603 of part counter information. The part codes, part consumed levels, and averaged market results service life values contained in the response data are set in the part code 1604, consumed level 1605 for a part code, and averaged results values 1606 for a part code repeatedly in accordance with the number of part counter information.

The process associated with the periodical transmission/reception sequence on the side of the copying machine 100 has been described above in detail.

<Example of Periodical Communication Process on Monitoring Server Side>

A process associated with the periodical transmission/reception sequence of the monitoring server 310 will be described with reference to FIGS. 13 to 16. The communication process on the monitoring server side is basically common to the periodical communication process and the part consumed level display mode on the device side.

Figure 13:
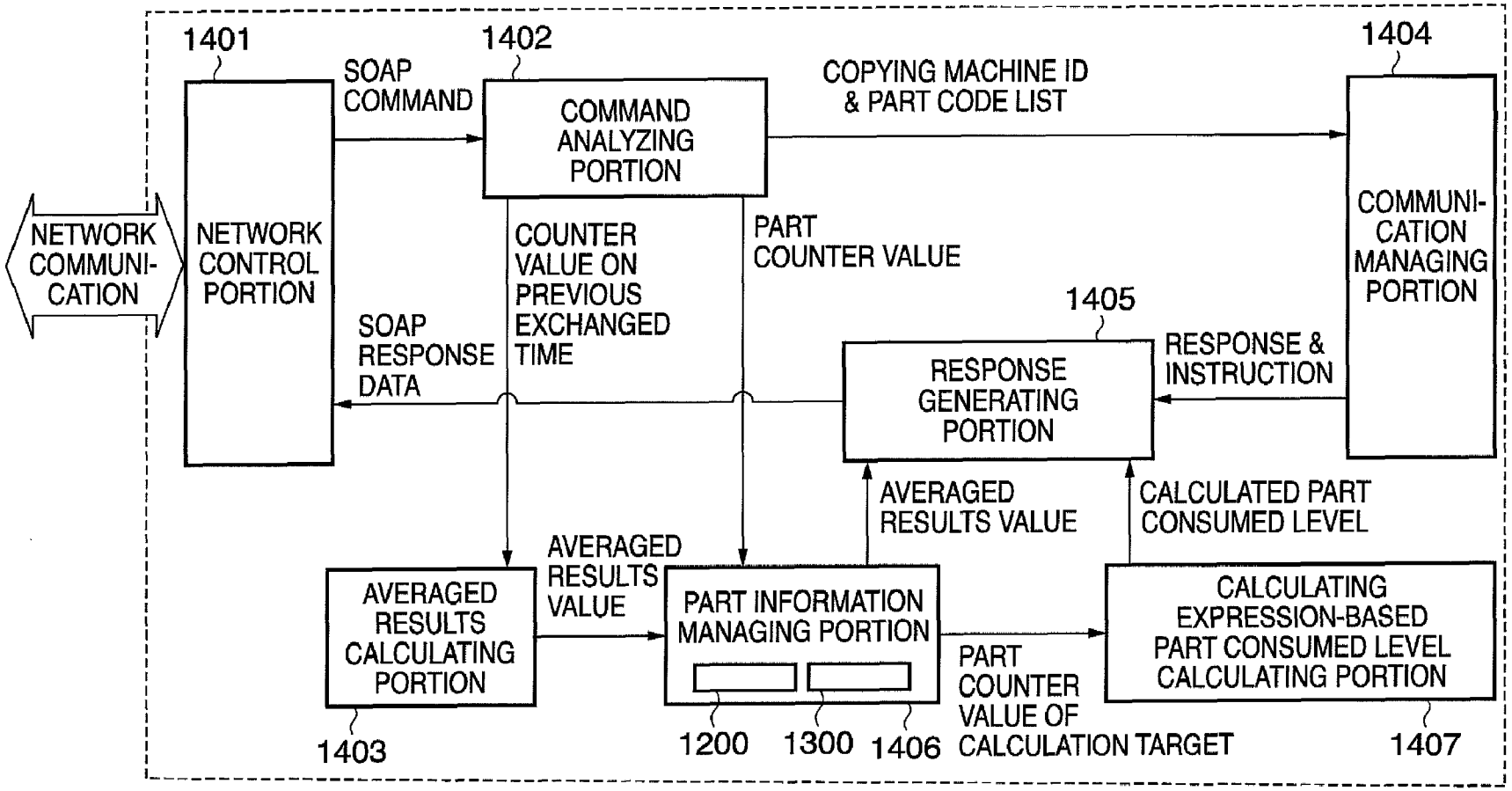
FIG. 13 is a block diagram showing an example of the functional arrangement of the monitoring server in a part counter reception process according to the embodiment.

FIG. 13 is a block diagram showing the functional blocks of the monitoring server 310 and the relationship between them. The entity of the functional blocks is a control program stored in the HDD 261. The functional blocks exchange data and control commands with each other by message communication via the RAM 254.

FIG. 14 is a view showing an example of the arrangement of a part managing master table stored in the monitoring server. FIG. 15 is a view showing an example of the arrangement of a part consumed level managing table stored in the monitoring server.

Figure 16A:
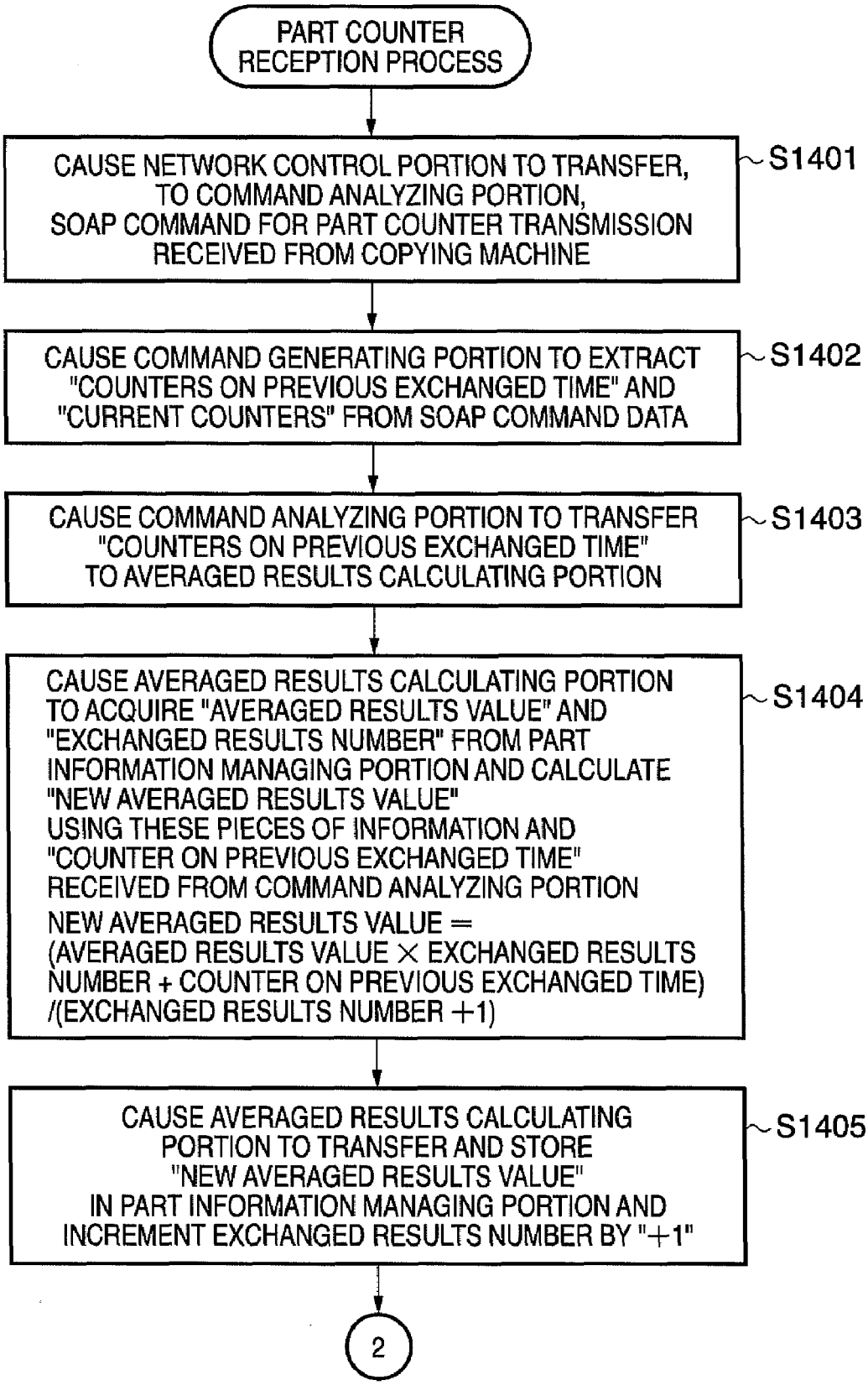
FIGS. 16A and 16B are flowcharts illustrating an example of the process procedure of part counter reception of the monitoring server shown in FIG. 13.
Figure 16B:
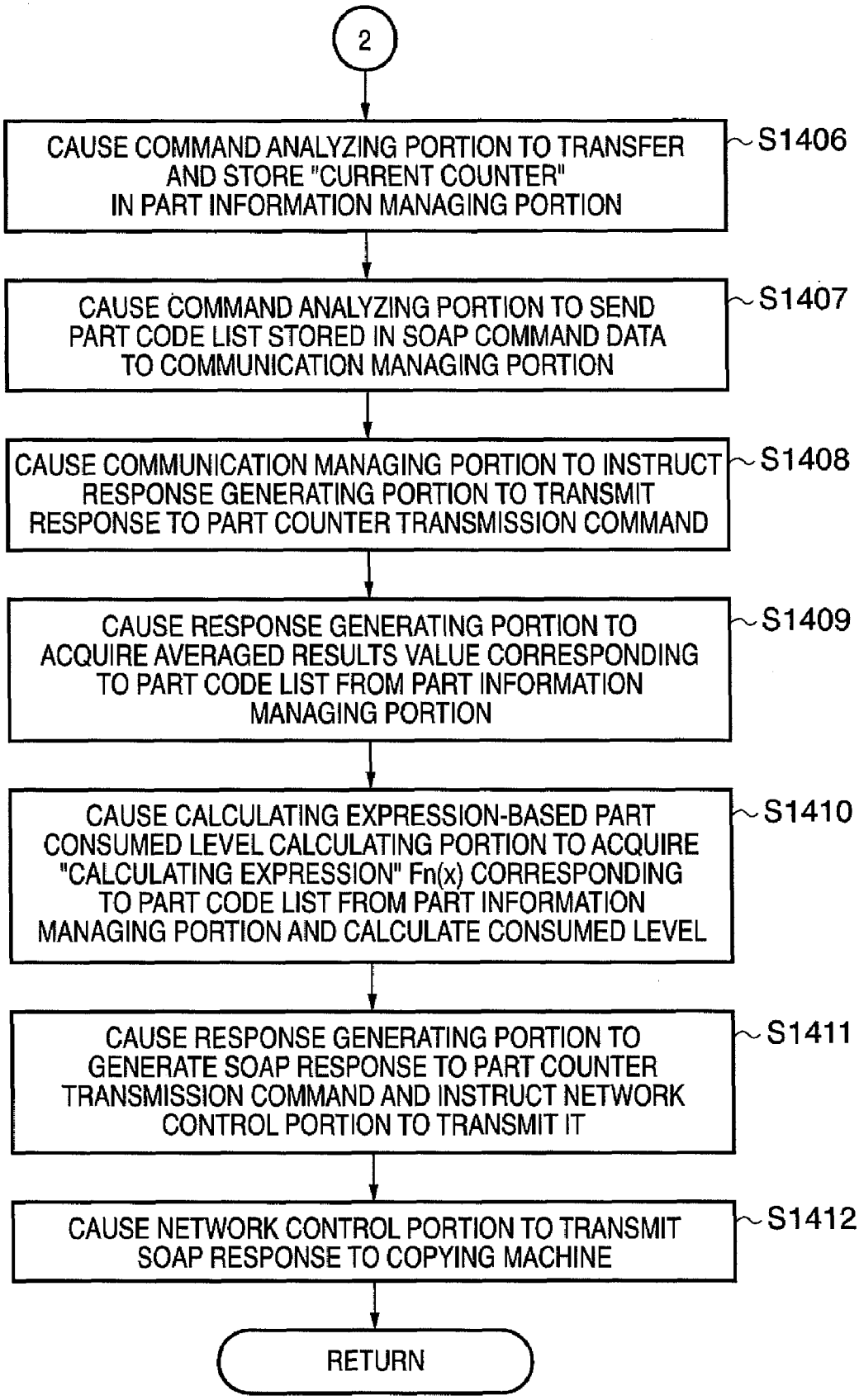

FIGS. 16A and 16B are flowcharts illustrating an example of the process procedure of the functional blocks of the monitoring server 310. Functional elements in FIG. 13 and execution of processing in FIGS. 16A and 16B are accomplished by the CPU 252 in FIG. 4 executing programs stored in memory.

A Network control portion 1401 shown in FIG. 13 always waits for communication from the copying machine 100. The Network control portion 1401 receives, from the copying machine 100, the above-described SOAP command representing part counter transmission and transfers it to a command analyzing portion 1402 in step S1401. In step S1402, the command analyzing portion 1402 parses the received SOAP command to extract copying machine IDs, part codes, part counter values, and counter values on a previous exchanged time. In step S1403, in association with the parts whose counter values on a previous exchanged time are extracted, the command analyzing portion 1402 transfers the part codes and the counter values on a previous exchanged time to an averaged results calculating portion 1403. In step S1404, the averaged results calculating portion 1403 acquires an averaged results value (A) and an exchanged results number (B) for each part code from a part managing master table 1300 to be described later (FIG. 14) via a part information managing portion 1406. The averaged results calculating portion 1403 calculates a new averaged results value in consideration of the counter value (C) on a previous exchanged time received in step S1403.

The new averaged results value is calculated in the following way.

$$\text{New averaged results value}=(A\times B+C)/(B+1)$$

In step S1405, the averaged results calculating portion 1403 updates an averaged results value column 1302 of the part managing master table 1300 (to be described later) to the newly calculated averaged results value and increments the value in an exchanged results number column 1303 by one via the part information managing portion 1406. This process corresponds to the process of an averaged results value updating unit.

A user exchanges a part of the copying machine 100 not only when the part has broken at the end of its life cycle. Parts are often exchanged before the end of the life cycle temporarily because no fault portion can be specified or due to a failure upon arrival. The averaged results value is the averaged value of the counter values (C) on a previous exchanged time, including all the above-described cases. That is, the averaged results value contains an error with respect to the averaged results value for only normal parts. Hence, a part consumed level (to be described later) calculated using the averaged results value also contains the error.

(Example of Part Managing Master Table)

FIG. 14 is a view showing an example of the arrangement of the part managing master table 1300 managed by the part information managing portion 1406. The part managing master table 1300 manages the part codes of exchangeable parts used in all monitoring target copying machines in advance as the part managing master table 1300. Since the part managing master table 1300 manages the parts based on the part codes, pieces of information about parts common to the plurality of copying machines are stored and managed together. The part managing master table 1300 corresponds to an averaged results value storage unit.

Part codes to uniquely specify the parts depending on the types are set in advance in a part code column 1301 of the table. Averaged market results service life values for the respective part codes are stored in the averaged results value column 1302. The initial value in this column is an assumed service life value predetermined for each part code at the time of production. The numbers of times of exchange for the respective part codes are stored the exchanged results number 1303. The initial value in this column is "1".

Consumed level calculating expressions F individually predefined for specific part codes are stored in a calculating expression column 1304. A part consumed level calculated by the monitoring server 310 on the basis of the consumed level calculating expression and managed in a part consumed level managing table to be described below corresponds to a first consumed level. The consumed level calculating expression defines a calculation to be executed for the part counter value of a specific part, whose consumed level has a correlation with those of a plurality of other parts, using a coefficient in accordance with the characteristic of the part. For example, assume that the consumed level of specific part 1 correlates to that of specific part 2. Let x be the part counter value of specific part 1, y be the part counter value of specific part 2, and a, b, and c be coefficients.

In this case, the consumed level calculating expression F of specific part 1 is defined by $$F=x\times a+(x-y)\times b+c$$

The consumed level calculating expression F allows to more accurately calculate a consumed level according to the operating state of each part, as compared to part consumed level calculation based on a statistical averaged results value.

The consumed level calculating expressions are sometimes derived and defined in the part managing master table 1300 at several timings. When consumed level calculating expressions are derived based on simulation results and durability tests in the development phase of the copying machine 100, they are normally defined in the part managing master table 1300 before the copying machine 100 of a certain model is released and used in the market. When consumed level calculating expressions are newly defined based on operation results data collected after the use has started in the market, only the consumed level calculating expressions F are additionally defined in the part managing master table 1300 that includes already defined expressions. When an inexpensive part is additionally developed as a replacement after the use has started in the market, the consumed level calculating expressions already defined in the part managing master table 1300 are redefined using new consumed level calculating expressions.

It is therefore necessary to make it possible to define the consumed level calculating expressions at an arbitrary timing. However, if the copying machine 100 holds the consumed level calculating expressions, it is very difficult to add or change the consumed level calculating expressions in all copying machines 100 used in the market. On the other hand, when the part managing master table 1300 of the monitoring server 310 holds the consumed level calculating expressions, as in this embodiment, the consumed level calculating expressions can easily be added or changed in only the part managing master table 1300.

In step S1406, the command analyzing portion 1402 in FIG. 13 updates a part counter column 1203 of a part consumed level managing table 1200 to be described later (FIG. 15) to the part counter values extracted in step S1403 via the part information managing portion 1406.

(Example of Part Consumed Level Managing Table)

FIG. 15 is a view showing an example of the arrangement of the part consumed level managing table 1200 managed by the part information managing portion 1406. The monitoring server 310 manages the part counter value and consumed level for each copying machine and for each part code as the part consumed level managing table 1200 on the basis of part counter value information transmission from the copying machine 100.

In step S1406, on the basis of a copying machine ID and part code extracted in step S1402, the command analyzing portion 1402 searches the part consumed level managing table 1200 for a corresponding record. Additionally, the command analyzing portion 1402 updates the part counter column 1203 to the part counter value extracted in step S1402. If no corresponding record is found, the extracted copying machine ID, part code, and part counter value are added to the part consumed level managing table 1200 as a new record.

In step S1407, the command analyzing portion 1402 sends the list of copying machine IDs and all part codes extracted in step S1402 to a communication managing portion 1404. In step S1408, the communication managing portion 1404 transfers, to a response generating portion 1405, the list of copying machine IDs and part codes received from the command analyzing portion 1402 and instructs to return a response to part counter transmission received from the copying machine 100.

Upon receiving this instruction, the response generating portion 1405 reads out the averaged results values of the parts corresponding to the part codes in the list from the part managing master table 1300 via the part information managing portion 1406 in step S1409. In step S1410, for only part codes having consumed level calculating expressions defined in the calculating expression column 1304 of the part managing master table 1300, consumed levels are calculated using the consumed level calculating expressions.

More specifically, the response generating portion 1405 sends the list of copying machine IDs and part codes to a calculating expression-based part consumed level calculating portion 1407 and instructs it to calculate consumed levels. The calculating expression-based part consumed level calculating portion 1407 reads out part counter values corresponding to the copying machine IDs and part codes in the received list from the part consumed level managing table 1200 via the part information managing portion 1406. When consumed level calculating expressions corresponding to the part codes in the received list are defined, the calculating expression-based part consumed level calculating portion 1407 reads out the calculating expressions from the part managing master table 1300. The calculating expression-based part consumed level calculating portion 1407 calculates consumed levels for the respective part codes by substituting the readout part counter values into the calculating expressions.

In step S1411, the response generating portion 1405 generates SOAP response data using the part code list, the averaged results values read out in step S1409, and the consumed levels calculated in step S1410. The SOAP response data is sent to the Network control portion 1401. At this time, the SOAP response data is generated without setting anything in a value surrounded by "<ns:consumed level xsi:type="xsd:short">" tags for a part code having no calculated consumed level. Finally, in step S1412, the Network control portion 1401 returns the SOAP response data to the copying machine 100.

The process on the side of the monitoring server 310 associated with the periodical transmission/reception sequence has been described above in detail. The process on the side of the monitoring server 310 associated with a manual transmission/reception sequence (to be described later) is almost the same as described above.

<Example of Monitoring by PC in Vendor Intranet Environment 30>

The PC 31 in the vendor intranet environment 30 communicates with the monitoring server 310 via the Internet 20 and acquires the operating state of each part of the image forming apparatus (e.g., copying machine) 100 in the customer intranet environment 10. An apparatus maintenance plan is made based on the operating states of the parts.

The PC 31 displays the operating states of the parts in, e.g., a screen (to be described later) (FIG. 20) displayed on the display unit of the copying machine. Alternatively, detailed information stored in the monitoring server 310 may be displayed.

The process of the PC 31 in the vendor intranet environment 30 is not the gist of the present invention, and a detailed description thereof will be omitted here.

<Example of Communication Process in Part Consumed Level Display Mode on Device Side of Embodiment>

(Outline of Manual Transmission/Reception Sequence)

The part counter value information transmission/reception sequence includes a transmission/reception sequence (to be referred to as a manual transmission/reception sequence hereinafter) executed when the user has invoked a part consumed level display screen by operating the operating portion 188 of the copying machine 100.

Figure 17:
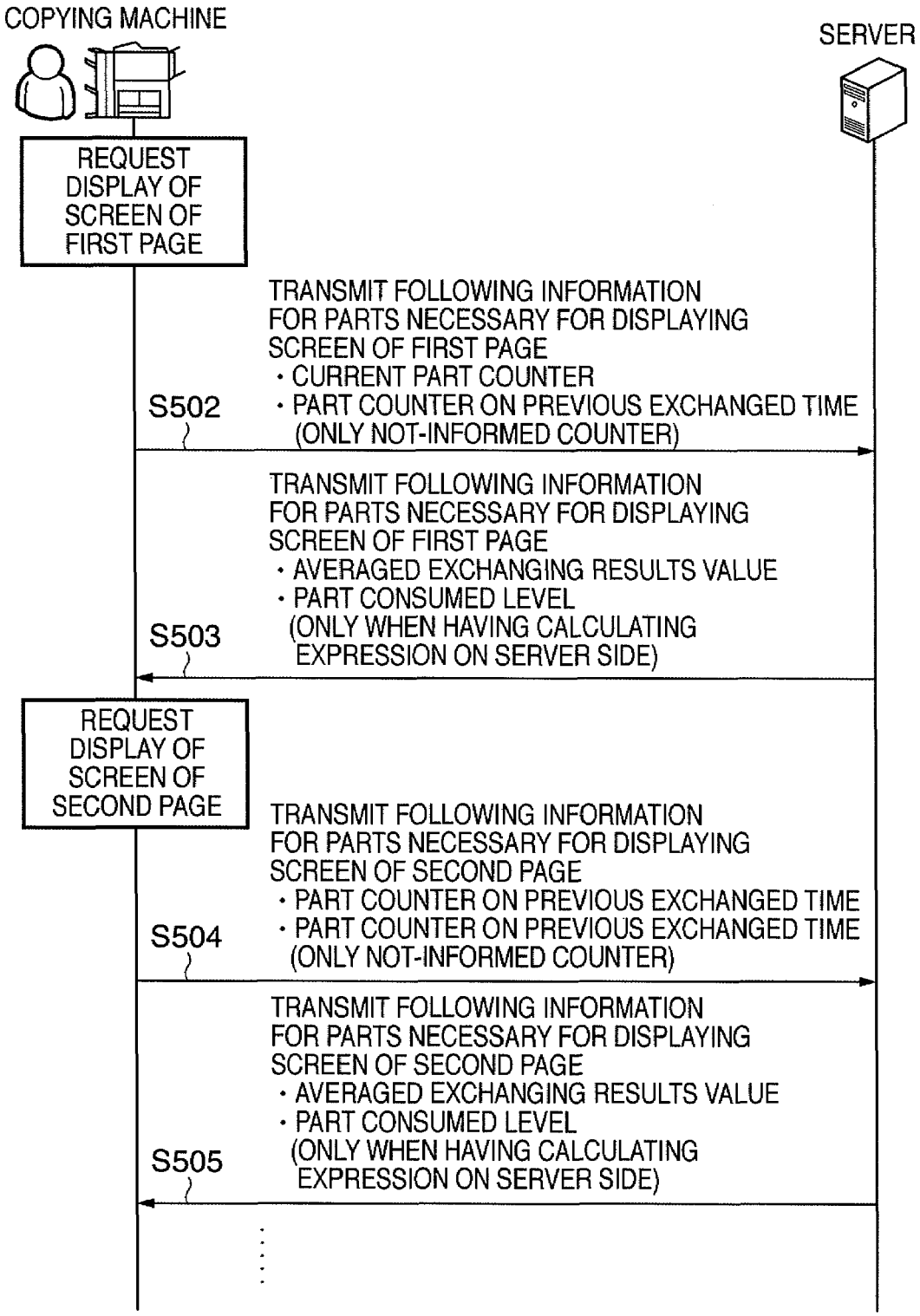
FIG. 17 is a sequence chart showing an example of the sequence of a part consumed level display process between the copying machine and the monitoring server according to the embodiment.

The outline of the manual transmission/reception sequence will be described with reference to FIG. 17.

Figure 20:
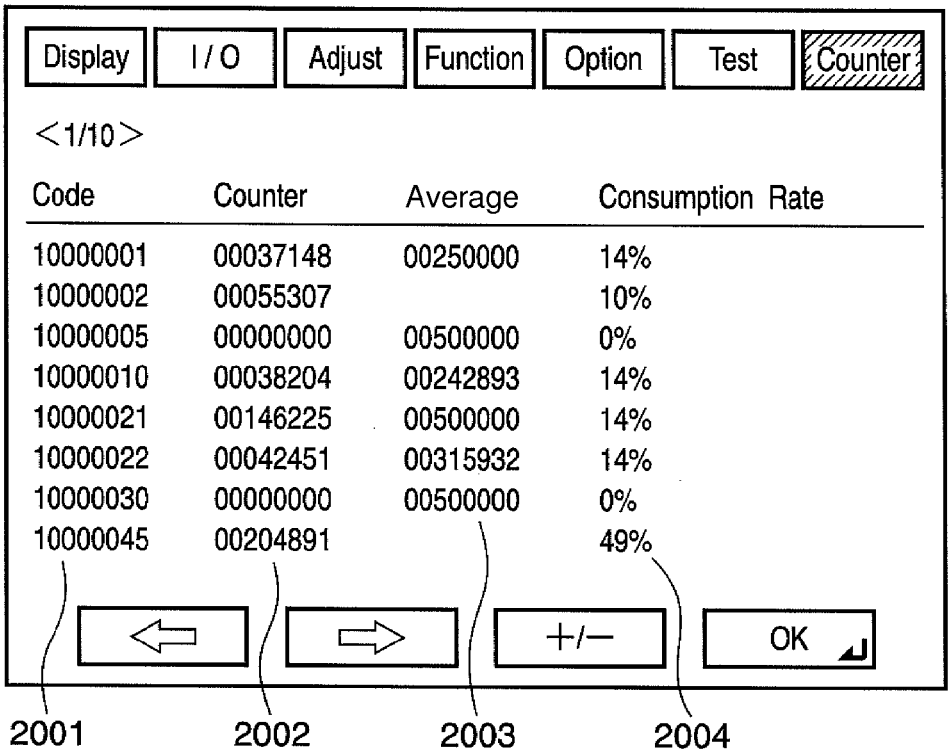
FIG. 20 is a view showing an example of a part consumed level display screen displayed on the operating portion of the copying machine according to the embodiment.

When the user has invoked a part consumed level display screen shown in FIG. 20 by operating the operating portion 188 of the copying machine 100, the copying machine 100 transmits, to the monitoring server 310, part counter information necessary for displaying the first page of the part consumed level display screen (S502). In this embodiment, eight pieces of part counter information are displayed in one screen, as shown in FIG. 20. More specifically, the part counter values of eight records from the top in the current count column 602 of the part counter managing table 600 are transmitted. In addition, the part counter values on a previous exchanged time related to parts in the records, for which the flag column 604 indicating informing of counter on a previous exchanged time has a value "OFF", are transmitted.

The monitoring server 310 returns averaged exchanging results values and part consumed levels to the copying machine 100 as a response to the transmission (S503). Upon receiving these values, the copying machine 100 writes them in the averaged results value column 605 and the consumed level column 606 of the part counter managing table 600. Then, the copying machine 100 displays the first page of the part consumed level display screen on the operating portion 188 on the basis of the information in the part counter managing table 600.

When the user has invoked the part consumed level display screen of the second page by operating the operating portion 188 of the copying machine 100, the copying machine 100 transmits, to the monitoring server 310, part counter information necessary for displaying the second page of the part consumed level display screen (S504). More specifically, the part counter values of the ninth to 16th records in the current count column 602 of the part counter managing table 600 are transmitted. In addition, the part counter values on a previous exchanged time related to parts in the records, for which the flag column 604 indicating informing of counter on a previous exchanged time has a value "OFF", are transmitted.

The monitoring server 310 returns averaged exchanging results values and part consumed levels to the copying machine 100 as a response to the transmission (S505). Upon receiving these values, the copying machine 100 writes them in the averaged results value column 605 and the consumed level column 606 of the part counter managing table 600. Then, the copying machine 100 displays the second page of the part consumed level display screen on the operating portion 188 on the basis of the information in the part counter managing table 600.

Every time the user instructs to change the page of the part consumed level display screen by operating the operating portion 188 of the copying machine 100, the same process as in the above-described sequences 504 and 505 is executed to display the part consumed level display screen of the page designated by the user on the operating portion 188.

<Example of Communication Process on Copying Machine Side>

The process on the side of the copying machine 100 associated with the manual transmission/reception sequence will be described in detail with reference to FIGS. 18 to 20.

Figure 18:
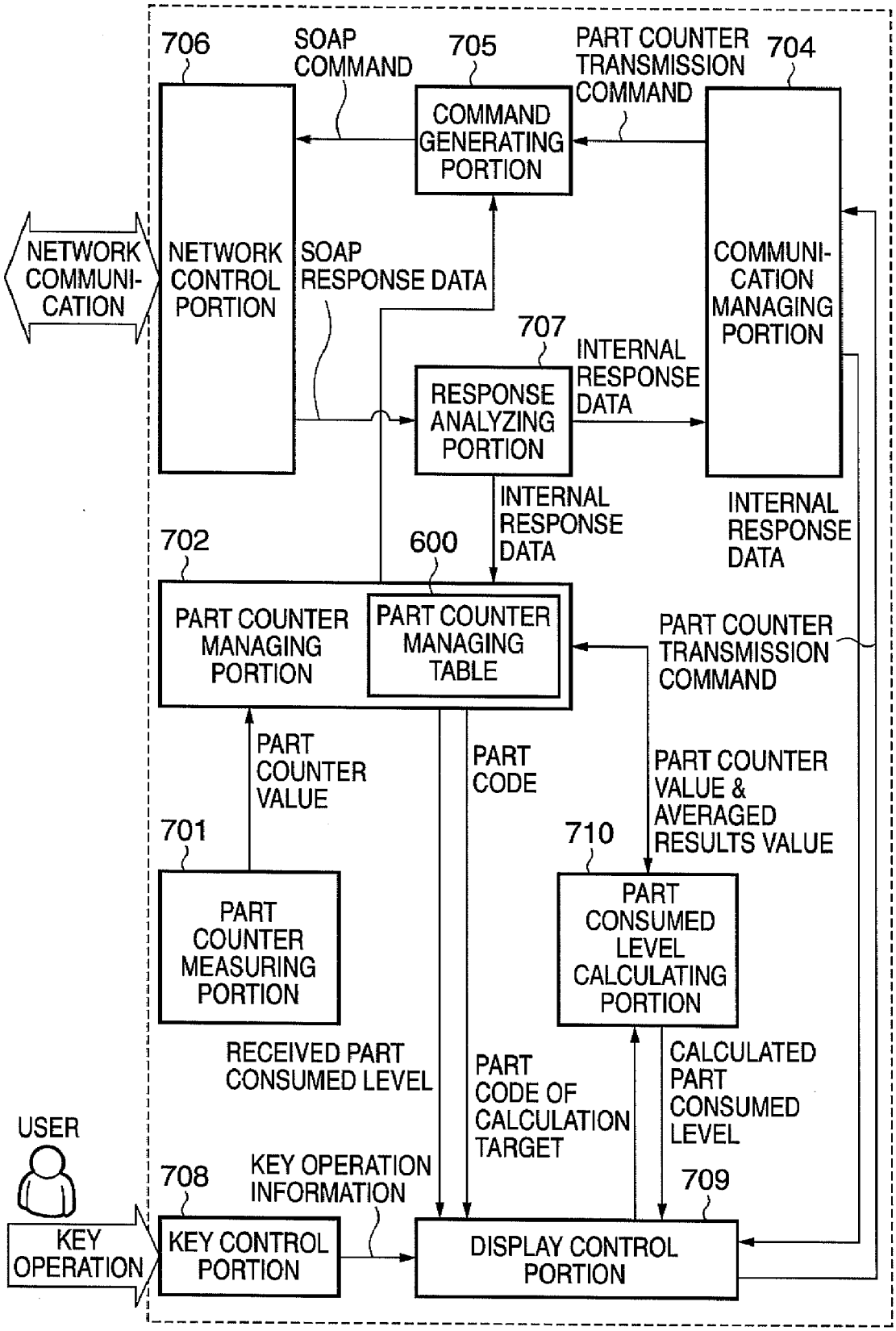
FIG. 18 is a block diagram showing an example of the functional arrangement of the copying machine in the part consumed level display process according to the embodiment.
Figure 19A:
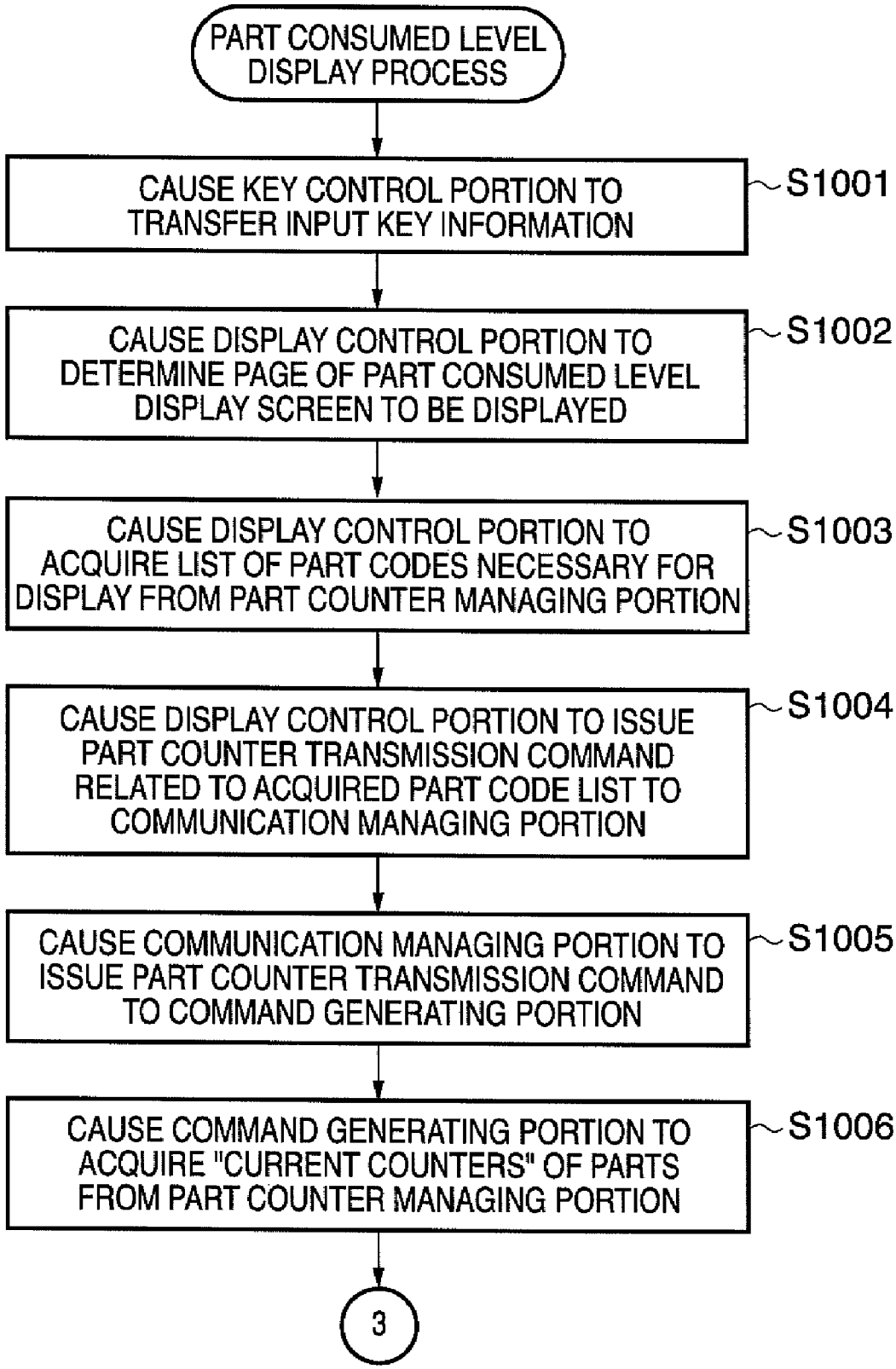
FIGS. 19A to 19D are flowcharts illustrating an example of the procedure of the part consumed level display process of the copying machine according to the embodiment.
Figure 19B:
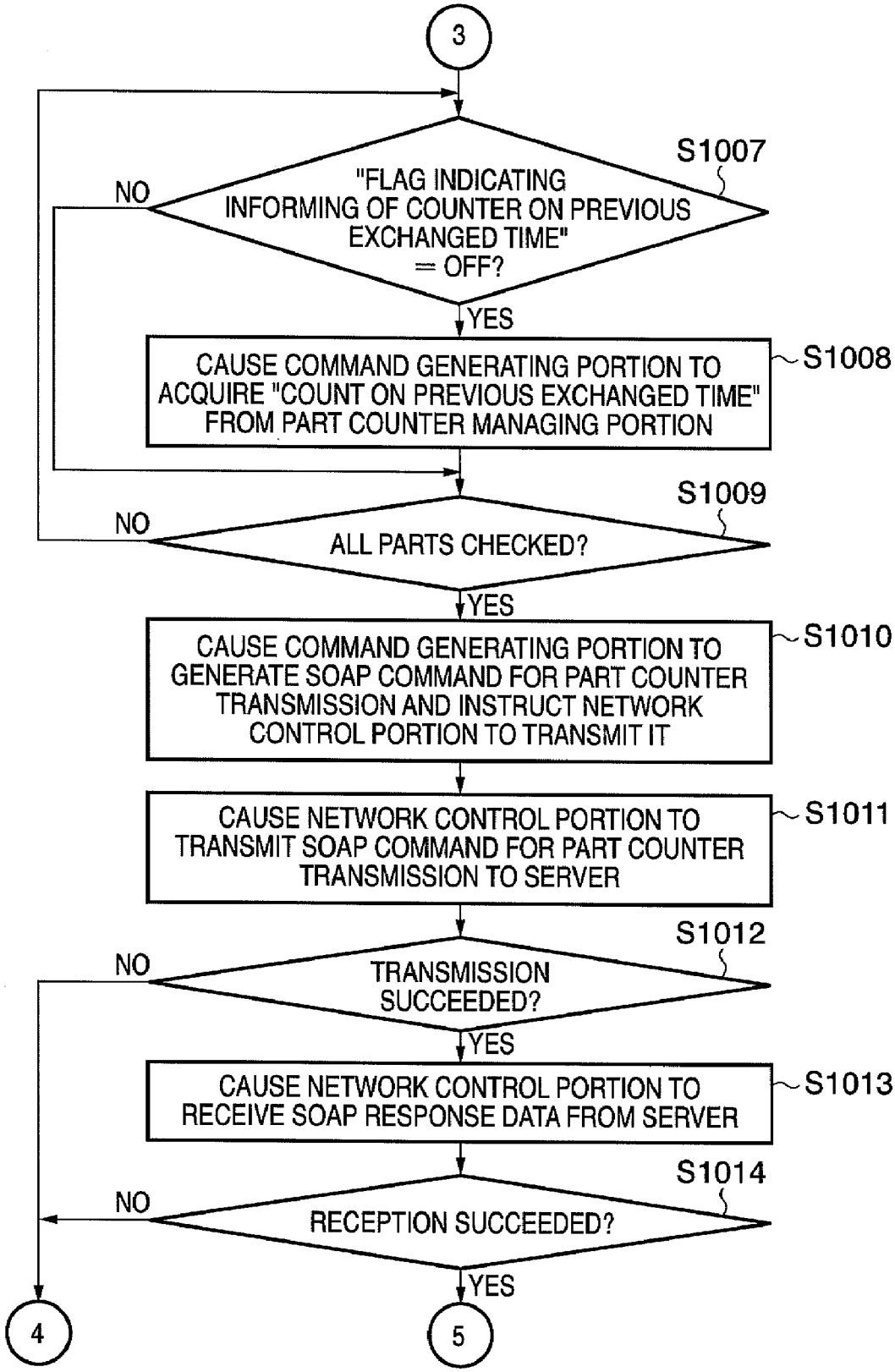
Figure 19C:
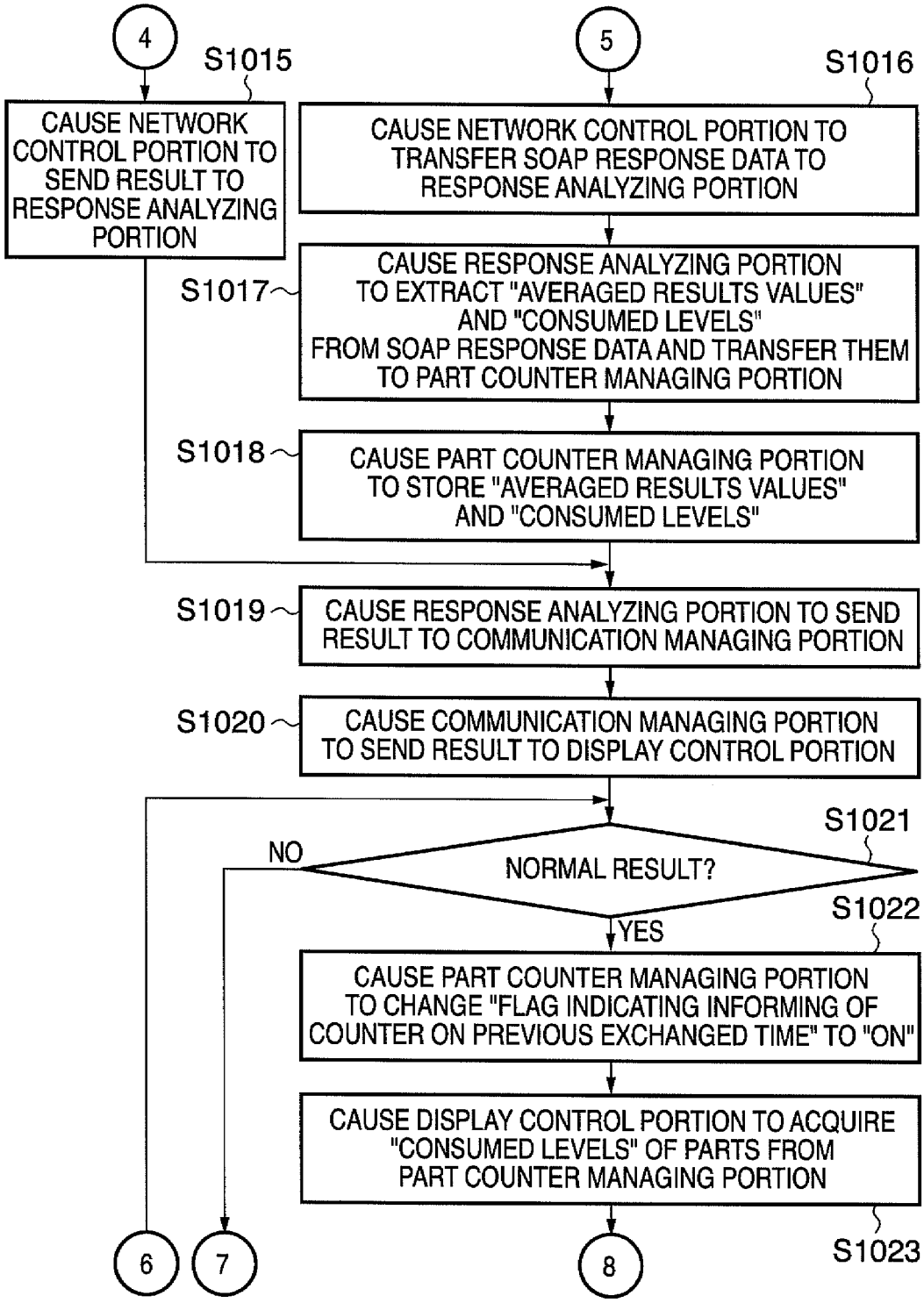
Figure 19D:
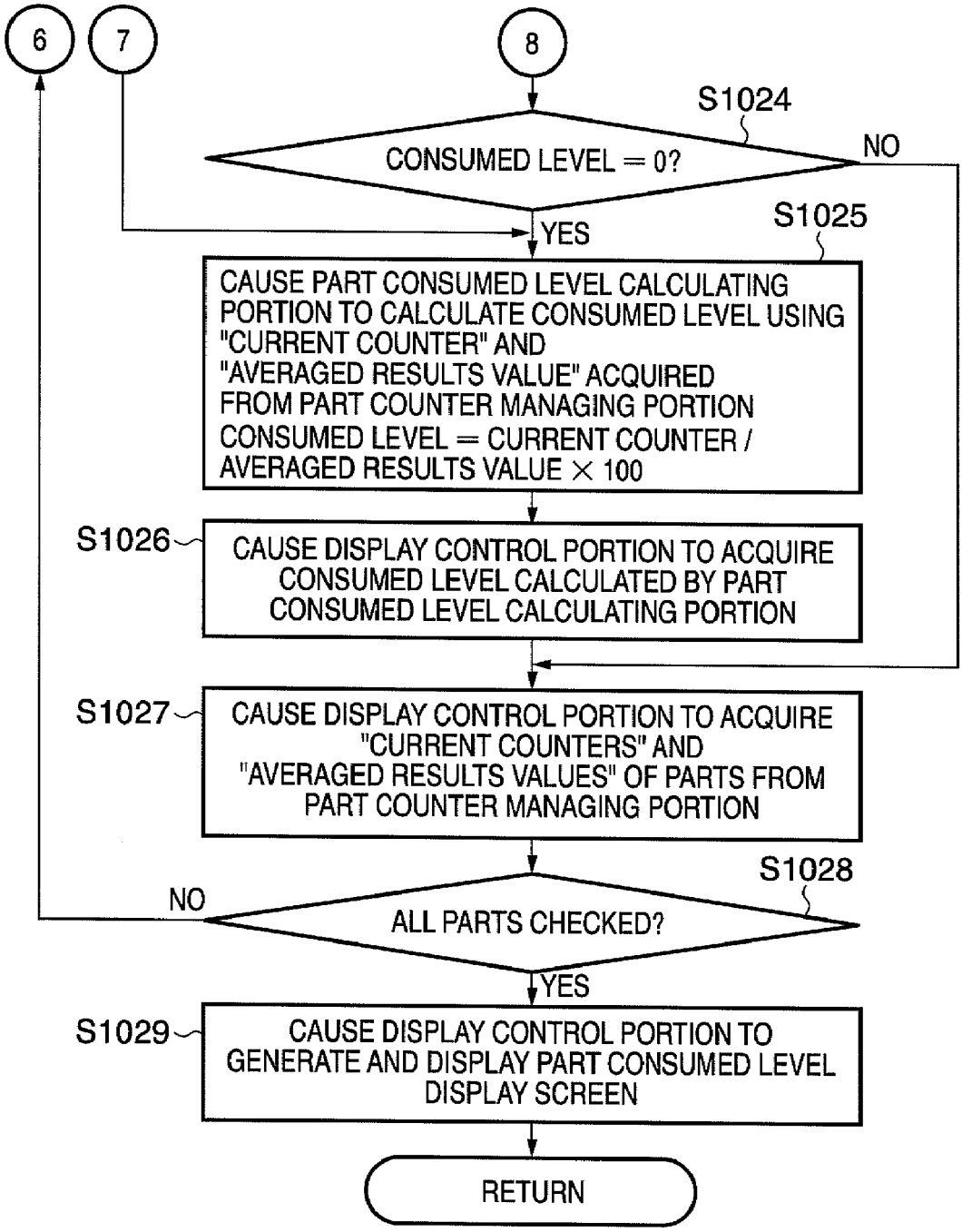

FIG. 18 is a block diagram showing the functional blocks of the copying machine 100 associated with the manual transmission/reception sequence and the relationship between them. The functional blocks exchange data and control commands with each other by message communication via the RAM 184.

FIGS. 19A to 19D are flowcharts illustrating the process procedure of the functional blocks of the copying machine 100 associated with the manual transmission/reception sequence. Functional elements in FIG. 18 and execution of processing in FIGS. 19A to 19D are accomplished by the CPU 186 in FIG. 3 executing programs stored in memory.

The part counter measuring portion 701 in FIG. 18 always counts the operating amounts of the parts in an operation such as copy or printing and transfers them to the part counter managing portion 702, as described above. When the user exchanges a part and instructs to reset the part counter value from the operating portion 188, the part counter measuring portion 701 transfers the current operating amount of the part to the part counter managing portion 702 as a counter value on a previous exchanged time. The part counter managing portion 702 writes these pieces of information received from the part counter measuring portion 701 in the current count column 602, count column 603 on a previous exchanged time, and flag column 604 indicating informing of counter on a previous exchanged time of the part counter managing table 600 (FIG. 7).

A key control portion 708 always monitors a user's hard-key operation or soft-key operation on the operating portion 188. Upon detecting a key operation, the key control portion 708 sends operation information such as a key code corresponding to an operated key to a display control portion 709.

The display control portion 709 generates screen display data on the operating portion 188 on the basis of the received operation information such as a key code and switches the display. Especially when the user instructs to display the part consumed level display screen shown in FIG. 20 in step S1001, the display control portion 709 determines in step S1002, on the basis of the current screen display contents, the page of the part consumed level display screen to be displayed. Additionally, in step S1003, the display control portion 709 reads out part codes necessary for displaying the part consumed level display screen of one page by referring to the part counter managing table 600 via the part counter managing portion 702.

More specifically, to display the first page, the part codes of the first to eighth records of the part counter managing table 600 are read out, as described above. To display the second page, the part codes of the ninth to 16th records are read out.

In step S1004, the display control portion 709 issues a part counter transmission command to the communication managing portion 704. The format of this command is the same as that of the part counter transmission command data shown in FIG. 9 described above. In this case, however, a value "0x0008" indicating transmission of eight pieces of part counter information is set in the number 1503 of part counter information. The eight part codes read out in step S1003 are set in the part code 1504 repeatedly. No values are particularly set in the sequence number 1501, part counter value 1505, and counter value 1506 on a previous exchanged time.

Upon receiving the part counter transmission command, the communication managing portion 704 employs and sets a unique sequence number in the sequence number 1501 of the command. In step S1005, the communication managing portion 704 issues the part counter transmission command to the command generating portion 705.

In step S1006, the command generating portion 705 reads out the part codes in the part counter transmission command and also reads out the current part counter values corresponding to the part codes in the part counter managing table 600 via the part counter managing portion 702. In steps S1007 to S1009, the command generating portion 705 reads out part counter values on a previous exchanged time related to parts for which the flag indicating informing of counter on a previous exchanged time is "OFF" in the part counter managing table 600. In step S1010, the command generating portion 705 generates a SOAP command based on these readout part counter values and sends it to the Network control portion 706 together with the sequence number in the part counter transmission command.

In step S1011, the Network control portion 706 transmits the SOAP command representing part counter transmission to the monitoring server 310. The format of this SOAP command is the same as that of the SOAP command data example shown in FIGS. 10A and 10B described above. In step S1012, the Network control portion 706 determines whether the SOAP command transmission to the monitoring server 310 has succeeded. If YES in step S1012, the Network control portion 706 waits for a SOAP response from the monitoring server 310 in step S1013. In step S1014, the Network control portion 706 determines whether the SOAP response reception has succeeded. IfYES in step S1014, the Network control portion 706 transfers the response data to the response analyzing portion 707 together with the sequence number in step S1016.

The process on the side of the monitoring server 310 which has received the above-described SOAP command from the Network control portion 706 is similar to the above-described periodical communication process, and a description thereof will not be repeated.

The response analyzing portion 707 receives the SOAP response data from the Network control portion 706 and, in step S1017, parses it to extract the number of part information, part codes, part consumed levels, and averaged results values. The response analyzing portion 707 generates internal response data and transfers it to the part counter managing portion 702. The format of this response data is the same as that of the response data shown in FIG. 12 described above.

In step S1018, the part counter managing portion 702 sets the averaged results values and part consumed levels in the response data in the averaged results value column 605 and consumed level column 606 associated with the parts in the part counter managing table 600. In step S1019, the response analyzing portion 707 sends the response data to the communication managing portion 704. In step S1020, the communication managing portion 704 sends the response data to the display control portion 709.

If the SOAP command transmission to the monitoring server 310 has failed in step S1012 described above, or if the SOAP response reception has failed in step S1014, the following process is executed. In step S1015, the Network control portion 706 sends information representing that the part counter transmission has failed to the response analyzing portion 707 together with the sequence number.

Upon receiving this information, the response analyzing portion 707 generates internal response data representing that the communication has failed. More specifically, a command code representing apart counter transmission failure is set in the command code 1602. Additionally, "0" is set in the number 1603 of part counter information. In step S1019, the response analyzing portion 707 transfers the internal response data to the communication managing portion 704. In step S1020, the communication managing portion 704 sends the response data to the display control portion 709.

The display control portion 709 repeats the process in steps S1021 to S1027 to be described below in accordance with the number of part codes set in the part counter transmission command issued in step S1004.

In step S1021, the display control portion 709 determines whether the communication with the monitoring server 310 has succeeded. If it is determined that the communication has succeeded, the display control portion 709 sets "ON" in the flag column 604 indicating informing of counter on a previous exchanged time corresponding to the part codes in the part counter managing table 600 via the part counter managing portion 702. In step S1023, the display control portion 709 acquires the consumed levels corresponding to the part codes from the consumed level column 606 of the part counter managing table 600 via the part counter managing portion 702. If it is determined in step S1024 that an acquired consumed level is "0", or if it is determined in step S1021 that the communication has failed, the display control portion 709 acquires a consumed level newly calculated by a part consumed level calculating portion 710 in steps S1025 and S1026. This process corresponds to control of an output control unit.

Hence, even when the network communication between the copying machine 100 and the monitoring server 310 is impossible because of, e.g., a failure, the copying machine 100 can calculate consumed levels by itself and continue the part consumed level display screen display process.

As the detailed process in steps S1025 and S1026, first, the display control portion 709 transfers the part codes to the part consumed level calculating portion 710 and instructs it to calculate consumed levels. Upon receiving the instruction, the part consumed level calculating portion 710 acquires part counter values (D) and averaged results values (E) corresponding to the part codes from the current count column 602 and averaged results value column 605 of the part counter managing table 600 via the part counter managing portion 702. The part consumed level calculating portion 710 calculates the consumed levels of the parts in accordance with $$\text{Consumed level}=D/E\times 100$$

and returns them to the display control portion 709.

The consumed level calculation in the copying machine 100 based on the consumed level calculating expression corresponds to second consumed level calculation by a second consumed level calculating unit.

If it is determined in step S1021 that the communication has failed, the averaged results values that are acquired in advance by the copying machine 100 from the monitoring server 310 in the above-described periodical transmission/reception sequence are used for the above-described consumed level calculation by the part consumed level calculating portion 710. However, since the averaged results values calculated on the side of the monitoring server 310 are the averaged values of the counter values on a previous exchanged time collected from a number of copying machines, the range of variations is very narrow. It is therefore possible to calculate consumed levels using the averaged results values without any particular problem.

After acquiring the consumed levels from the part consumed level calculating portion 710, the display control portion 709 acquires the part counter values and averaged results values corresponding to the part codes in the part counter managing table 600 from the current count column 602 and averaged results value column 605 in step S1027. The process in step S1027 is also executed when it is determined in step S1024 that a consumed level is not "0".

The display control portion 709 repeats the above-described process in steps S1021 to S1027 until all pieces of part information necessary for displaying the part consumed level display screen of one page are acquired. If it is determined in step S1028 that all pieces of part information are acquired, the display control portion 709 generates part consumed level display screen data and displays it on the operating portion 188 in step S1029.

(Example of Part Consumed Level Display Screen)

FIG. 20 shows an example of the part consumed level display screen of the first page.

The display control portion 709 displays, in a "Code" column 2001, the eight part codes set in the part counter transmission command issued in step S1004. The part counter values acquired in step S1027 are displayed in a "Counter" column 2002 in relation to the part codes. For only parts whose consumed levels are calculated using the averaged results values in step S1025, the averaged results values acquired in step S1027 are displayed in an "Average" column 2003 in relation to the part codes. The consumed levels acquired in step S1023 or S1026 are displayed in a "Consumption Rate" column 2004 in relation to the part codes. At this time, the consumed levels acquired in step S1026, i.e., the consumed levels calculated by the part consumed level calculating portion 710 on the side of the copying machine 100 are displayed preferentially.

The process on the side of the copying machine 100 associated with the manual transmission/reception sequence has been described above in detail. The monitoring server 310 executes the same process in both the periodical transmission/reception sequence and the manual transmission/reception sequence, and a description thereof will be omitted here.

According to the embodiment of the present invention described above in detail, it is possible to display the part consumed level display screen on the operating portion on the side of the copying machine 100 independently of the communication state between the copying machine 100 and the monitoring server 310.

In the above-described embodiment, monitoring of part consumed levels and management of information about consumed levels have been explained using an image forming apparatus such as a copying machine or a printer as an example. However, the present invention is applicable not only to an image forming apparatus but also to a system having a monitoring device for monitoring a plurality of processing apparatuses via communication.

The object of the present invention can also be achieved by supplying a storage medium which records software program codes for implementing the functions of the above-described embodiment to a system or apparatus and causing the computer (or CPU or MPU) of the system or apparatus to read out and execute the program codes stored in the storage medium.

In this case, the program codes read out from the storage medium implement the functions of the above-described embodiment by themselves, and the program codes and the storage medium storing them constitute the present invention.

Examples of the storage medium to supply the program codes are a Floppy® disk, hard disk, magnetooptical disk, CD-ROM, CD-R, and CD-RW. A DVD-ROM, DVD-RAM, DVD-RW, DVD+RW, magnetic tape, nonvolatile memory card, and ROM are also usable. The program codes may be downloaded via a network.

The functions of the above-described embodiment are implemented when the computer executes the readout program codes. The functions of the above-described embodiment are also implemented when the OS (Operating System) running on the computer partially or wholly executes actual processing on the basis of the instructions of the program codes.

Alternatively, the program codes read out from the storage medium are written in the memory of a function expansion board inserted into the computer or a function expansion unit connected to the computer. In this case, the functions of the above-described embodiments are implemented when the CPU of the function expansion board or function expansion unit partially or wholly executes actual processing on the basis of the instructions of the program codes.

In this case, the program is supplied directly from the storage medium storing the program or downloaded from, e.g., another computer or database (not shown) connected to, e.g., the Internet, commercial network, or local area network.

In the above-described embodiment, the image forming apparatus employs electrophotography as a printing method. However, the present invention is applicable not only to electrophotography but also to various kinds of printing methods including an inkjet method, thermal transfer method, thermal printing method, electrostatic method, and electrosensitive method.

The program can take any form such as an object code, a program code to be executed by an interpreter, or script data to be supplied to the OS (Operating System).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-106365, filed on Apr. 13, 2007, which is hereby incorporated by reference herein in its entirety.

What is claimed is:

1. An image forming apparatus capable of communicating, via the internet, with an external monitoring device for monitoring operating states of a plurality of image forming apparatuses, comprising:

a storage unit adapted to detect an operating amount of a part included in the image forming apparatus and store information about the operating, amount in relation to the part;

an informing unit adapted to inform the external monitoring device of a request for acquiring a first consumed level of the part calculated by the external monitoring device, the request containing the information about the operating amount of the part;

an acquiring unit adapted to acquire the first consumed level of the part and a value to be used to calculate a second consumed level of the part from the external monitoring device, as a response to the request for acquiring the first consumed level of the part sent by said informing unit;

a calculation unit adapted to calculate the second consumed level of the part based on the information about the operating amount stored in said storage unit and the value acquired by said acquiring unit to be used to calculate the second consumed level of the part; and an output unit adapted to output the first consumed level in relation to the part when said acquiring unit has acquired the first consumed level of the part from the external monitoring device and output the calculated second consumed level in relation to the part when said acquiring unit cannot acquire the first consumed level of the part from the external monitoring device, wherein the value to be acquired by said acquiring unit and used to calculate the second consumed level of the part is updated in the external monitoring device every time the external monitoring device acquires information about operating amount of the part from any one of the plurality of image forming apparatuses of which the operating statuses are monitored by the external monitoring device.

2. The apparatus according to claim 1, wherein the information about operating amount of the part includes at least a part counter value representing a number of operations after exchange of the part and a part counter value had by the part on a previous exchanged time of the part.

3. The apparatus according to claim 2, wherein the value to be used to calculate the second consumed level of the part is an averaged results value of a common part of the plurality of image forming apparatuses, which is calculated in the external monitoring device based on part counter values on respective exchanged time of the common part sent from the plurality of image forming apparatuses, and said calculation unit calculates the second consumed level of the part based on the averaged results value and the information about the operating amount stored in said storage unit.

4. The apparatus according to claim 3, wherein said calculation unit acquires, from said storage unit, a part counter value (D) representing a number of operations after exchange of the part and an averaged results value (E) representing the number of operations until exchange based on a part exchanged result, and calculates the second consumed level by an expression, the second consumed level=D/E×100.

5. An information processing method in an image forming apparatus capable of communicating, via the internet, with an external monitoring device for monitoring operating states of a plurality of image forming apparatuses, comprising the steps of:

detecting an operating amount of a part included in the image forming apparatus and storing information about the operating amount in relation to the part into a storage unit;

informing the external monitoring device of a request for acquiring a first consumed level of the part calculated by the external monitoring device, the request containing the information about the operating amount of the part;

acquiring the first consumed level of the part and a value to be used to calculate a second consumed level of the part from the external monitoring device, as a response to the request for acquiring the first consumed level of the part sent in the informing step;

calculating the second consumed level of the part based on the information about the operating amount stored in the storage unit and the value acquired in the acquiring step to be used to calculate the second consumed level of the part; and outputting the first consumed level in relation to the part when the first consumed level of the part is acquired from the external monitoring device in the acquiring step or outputting the calculated second consumed level in relation to the part when the first consumed level of the part cannot be acquired from the external monitoring device in the acquiring step, wherein the value to be acquired in the acquiring step and used to calculate the second consumed level of the part is updated in the external monitoring device every time the external monitoring device acquires information about operating amount of the part from any one of the plurality of image forming apparatuses of which the operation statuses are monitored by the external monitoring device.

6. The method according to claim 5, wherein the information about operating amount of the part includes at least a part counter value representing a number of operations after exchange of the part and a part counter value had by the part on a previous exchanged time of the part.

7. The method according to claim 6, wherein the value to be used to calculate the second consumed level of the part is an averaged results value of a common part of the plurality of image forming apparatuses, which is calculated in the external monitoring device based on part counter values on respective exchanged time of the common part sent from the plurality of image forming apparatuses, and in the calculating step, the second consumed level of the part is calculated based on the averaged results value and the information about the operating amount stored in the storage unit.

8. The method according to claim 7, wherein in the calculating step, a part counter value (D) representing the number of operations after exchange of the part and an averaged results value (E) representing the number of operations until exchange based on a part exchanged result are acquired from the storing step, and the second consumed level is calculated by an expression, the second consumed level=D/E×100.

9. A non-transitory computer-readable storage medium which stores a program for implementing an information processing method in an image forming apparatus capable of communicating, via the internet, with an external monitoring device for monitoring operating states of a plurality of image forming apparatuses, the program causing a computer to execute the steps of:

detecting an operating amount of a part included in the image forming apparatus and storing information about the operating amount in relation to the part into a storage unit;

informing the external monitoring device of a request for acquiring a first consumed level of the part calculated by the external monitoring device, the request containing the information about the operating amount of the part;

acquiring the first consumed level of the part and a value to be used to calculate a second consumed level of the part from the external monitoring device, as a response to the request for acquiring the first consumed level of the part sent in the informing step;

calculating the second consumed level of the part based on the information about the operating amount stored in the storage unit and the value acquired in the acquiring step to be used to calculate the second consumed level of the part; and outputting the first consumed level in relation to the part when the first consumed level of the part is acquired from the external monitoring device in the acquiring step or outputting the calculated second consumed level in relation to the part when the first consumed level of the part cannot be acquired from the external monitoring device in the acquiring step, wherein the value to be acquired in the acquiring step and used to calculate the second consumed level of the part is updated in the external monitoring device every time the external monitoring device acquires information about operating amount of the part from any one of the plurality of image forming apparatuses on which the operating statuses are monitored by the external monitoring device.

10. An image forming system comprising a plurality of image forming apparatuses, and an external monitoring device which can communicate with said plurality of image forming apparatuses via the internet and monitors operating states of said plurality of image forming apparatuses, each of said image forming apparatuses comprising:

a first storage unit adapted to detect an operating amount of a part included in the image forming apparatus and store information about the operating amount in relation to the part;

an informing unit adapted to inform said external monitoring device of a request for acquiring a first consumed level of the part calculated by said external monitoring device, the request containing the information about the operating amount of the part;

an acquiring unit adapted to acquire the first consumed level of the part and a value to be used to calculate a second consumed level of the part from said external monitoring device, as a response to the request for acquiring the first consumed level of the part sent by said informing unit;

a calculation unit adapted to calculate the second consumed level of the part based on the information about the operating amount stored in said first storage unit and the value acquired by said acquiring unit to be used to calculate the second consumed level of the part; and an output unit adapted to output the first consumed level in relation to the part when said acquiring unit has acquired the first consumed level of the part from said external monitoring device or output the calculated second consumed level in relation to the part when said acquiring unit cannot acquire the first consumed level of the part from said external monitoring device, and said external monitoring device comprising:

a second storage unit adapted to store the information about operating amount of the part included in the image forming apparatus, which is contained in the request sent from each of said plurality of image forming apparatus, in relation to the image forming apparatus and the part;

an updating unit adapted to update the value to be used by said calculation unit of the image forming apparatus to calculate the second consumed level of the part upon acquiring the information about operating amount of the part from any one of said plurality of image forming apparatuses; and a transmission unit adapted to calculate the first consumed level of the part using a calculating expression for calculating the first consumed level corresponding to the part included in the image forming apparatus and transmit the calculated first consumed level and the value to be used to calculate the second consumed level of the part, which is updated by said updating unit, to the image forming apparatus, as a response to the request sent from the image forming apparatus.

11. A method in an image forming system comprising a plurality of image forming apparatuses, and an external monitoring device which can communicate with the plurality of image forming apparatuses via the internet and monitors operating states of the plurality of image forming apparatuses, each of the image forming apparatuses comprising the steps of:

detecting an operating amount of a part included in the image forming apparatus and storing information about the operating amount in correction to the part into a first storage unit;

informing the external monitoring device of a request for acquiring a first consumed level of the part calculated by the external monitoring device, the request containing the information about the operating amount of the part;

acquiring the first consumed level of the part and a value to be used to calculate a second consumed level of the part from the external monitoring device, as a response to the request for acquiring the first consumed level of the part sent in the informing step;

calculating the second consumed level of the part based on the information about the operating amount stored in the first storage unit and the value acquired in the acquiring step to be used to calculate the second consumed level of the part; and outputting the first consumed level in relation to the part when the first consumed level of the part is acquired from the external monitoring device in the acquiring step and outputting the calculated second consumed level in relation to the part when the first consumed level of the part cannot be acquired from the external monitoring device in the acquiring step, and the external monitoring device comprising the steps of:

storing the information about operating amount of the part included in the image forming apparatus, which is contained in the request sent from each of the plurality of image forming apparatus, in relation to the image forming apparatus and the part into a second storage unit;

updating the value to be used in the calculation step of the image forming apparatus to calculate the second consumed level of the part upon acquiring the information about operating amount of the part from any one of the plurality of image forming apparatuses; and calculating the first consumed level of the part using a calculating expression for calculating the first consumed level corresponding to the part included in the image forming apparatus and transmitting the calculated first consumed level and the value to be used to calculate the second consumed level of the part, which is updated in the updating step, to the image forming apparatus, as a response to the request sent from the image forming apparatus.

* * * * *